US010260529B2

(12) United States Patent
Hughes et al.

(10) Patent No.: US 10,260,529 B2
(45) Date of Patent: Apr. 16, 2019

(54) FAN

(71) Applicant: Dyson Technology Limited, Wiltshire (GB)

(72) Inventors: Ryan Alexander Hughes, Bristol (GB); Steven Eduard Peet, Bristol (GB); Jason Ryan King, Bristol (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 219 days.

(21) Appl. No.: 15/043,414

(22) Filed: Feb. 12, 2016

(65) Prior Publication Data

US 2016/0238038 A1 Aug. 18, 2016

(30) Foreign Application Priority Data

Feb. 13, 2015 (GB) ..... 1502480.5

(51) Int. Cl.

| | |
|---|---|
| ***F04D 29/70*** | (2006.01) |
| ***F04D 25/08*** | (2006.01) |
| ***F04D 29/08*** | (2006.01) |
| ***F04D 29/62*** | (2006.01) |
| ***F04F 5/16*** | (2006.01) |

(52) U.S. Cl.

CPC ..... *F04D 29/703* (2013.01); *F04D 25/08* (2013.01); *F04D 29/083* (2013.01); *F04D 29/626* (2013.01); *F04F 5/16* (2013.01)

(58) Field of Classification Search

CPC ..... F04D 25/08; F04D 29/703
USPC ..... 96/63; 55/357, 471; 417/158, 198; 415/121.2
See application file for complete search history.

(56) References Cited

U.S. PATENT DOCUMENTS

| | | | |
|---|---|---|---|
| 1,819,498 | A | 8/1931 | Cole |
| 2,488,467 | A | 11/1949 | De Lisio |
| 3,577,710 | A | 5/1971 | Feldman |
| 3,850,598 | A | 11/1974 | Boehm |
| 4,477,270 | A | 10/1984 | Tauch |
| 4,856,968 | A | 8/1989 | Armbruster |
| 4,905,340 | A | 3/1990 | Gutschmit |

(Continued)

FOREIGN PATENT DOCUMENTS

| | | |
|---|---|---|
| CN | 102230482 | 11/2011 |
| CN | 102840161 | 12/2012 |

(Continued)

OTHER PUBLICATIONS

Search Report dated Aug. 4, 2015, directed to GB Application No. 1502480.5; 1 page.

(Continued)

*Primary Examiner* — Timothy L Maust
(74) *Attorney, Agent, or Firm* — Morrison & Foerster LLP

(57) ABSTRACT

Described is a fan assembly comprising a body comprising an air inlet, an air outlet, and means for generating an air flow through the body. The fan assembly also comprises a nozzle for receiving the air flow from the body and for emitting the air flow, a filter upstream from the air inlet and having an upstream surface and a downstream surface, a seat on the body having an upwardly facing surface for supporting the filter, and sealing means for forming a seal between the filter and the body to define a flow path between the downstream surface of the filter and the air inlet.

16 Claims, 14 Drawing Sheets

(56) References Cited

U.S. PATENT DOCUMENTS

| | | | | |
|---|---|---|---|---|
| 5,266,004 | A | 11/1993 | Tsumurai et al. | |
| 5,266,090 | A | 11/1993 | Burnett | |
| 5,342,175 | A * | 8/1994 | Patton | F04D 29/703 415/121.2 |
| 5,435,817 | A | 7/1995 | Davis et al. | |
| 5,753,000 | A * | 5/1998 | Chiu | B01D 46/24 55/357 |
| 5,837,020 | A | 11/1998 | Cartellone | |
| 6,007,608 | A | 12/1999 | Johnson | |
| 6,364,618 | B1 | 4/2002 | Moreno | |
| 6,511,531 | B1 * | 1/2003 | Cartellone | A61L 9/03 261/142 |
| 6,699,301 | B1 | 3/2004 | Eisenhauer | |
| 7,320,721 | B2 | 1/2008 | Ham et al. | |
| 8,212,439 | B2 | 7/2012 | Dautel et al. | |
| 8,672,367 | B2 | 3/2014 | Jacklich et al. | |
| 8,770,946 | B2 | 7/2014 | Fitton et al. | |
| 8,882,451 | B2 * | 11/2014 | Fitton | F04D 25/084 415/121.2 |
| 8,926,739 | B2 * | 1/2015 | Morgan | B01D 53/30 96/111 |
| 8,932,028 | B2 | 1/2015 | Fitton et al. | |
| 9,797,612 | B2 | 10/2017 | Staniforth et al. | |
| 9,797,613 | B2 | 10/2017 | Staniforth et al. | |
| 2003/0228142 | A1 | 12/2003 | Reiker | |
| 2006/0201119 | A1 | 9/2006 | Song | |
| 2006/0207232 | A1 | 9/2006 | Ham et al. | |
| 2008/0166224 | A1 * | 7/2008 | Giffin | F04D 29/4206 415/121.2 |
| 2009/0188126 | A1 | 7/2009 | Gaillard et al. | |
| 2010/0226763 | A1 | 9/2010 | Gammack et al. | |
| 2011/0072770 | A1 | 3/2011 | Lakdawala et al. | |
| 2011/0236219 | A1 | 9/2011 | Fitton et al. | |
| 2011/0236228 | A1 | 9/2011 | Fitton et al. | |
| 2014/0084492 | A1 | 3/2014 | Staniforth et al. | |
| 2015/0017028 | A1 | 1/2015 | Hodgson et al. | |
| 2016/0238024 | A1 | 8/2016 | Johnson et al. | |
| 2016/0238025 | A1 | 8/2016 | Stewart et al. | |
| 2016/0238026 | A1 | 8/2016 | Barclay | |
| 2016/0238037 | A1 | 8/2016 | Peet et al. | |
| 2016/0238039 | A1 | 8/2016 | Stewart et al. | |

FOREIGN PATENT DOCUMENTS

| | | |
|---|---|---|
| CN | 202833343 | 3/2013 |
| CN | 203161566 | 8/2013 |
| CN | 203548333 | 4/2014 |
| CN | 204140468 | 2/2015 |
| EP | 0 136 894 | 4/1985 |
| EP | 1 980 432 | 10/2008 |
| GB | 2 157 765 | 10/1985 |
| GB | 2464736 | 4/2010 |
| GB | 2468312 | 9/2010 |
| GB | 2478925 | 9/2011 |
| GB | 2478926 | 9/2011 |
| GB | 2478927 | 9/2011 |
| GB | 2499041 | 8/2013 |
| GB | 2500007 | 9/2013 |
| GB | 2500010 | 9/2013 |
| GB | 2500274 | 9/2013 |
| GB | 2502106 | 11/2013 |
| GB | 2509111 | 6/2014 |
| GB | 2510196 | 7/2014 |
| GB | 2510197 | 7/2014 |
| GB | 2518638 | 4/2015 |
| JP | 47-7490 | 3/1972 |
| JP | 63-36794 | 3/1988 |
| JP | 64-21300 | 2/1989 |
| JP | 5-166954 | 7/1993 |
| JP | 6-56397 | 8/1994 |
| JP | 10-339295 | 12/1998 |
| JP | 11-148484 | 6/1999 |
| JP | 2001-124373 | 5/2001 |
| JP | 2004-232954 | 8/2004 |
| JP | 2004-340071 | 12/2004 |
| JP | 2011-196383 | 10/2011 |
| JP | 2013-185597 | 9/2013 |
| JP | 2014-123950 | 7/2014 |
| WO | WO-2009/030678 | 3/2009 |
| WO | WO-2009/030879 | 3/2009 |
| WO | WO-2010/046691 | 4/2010 |
| WO | WO-2010/100452 | 9/2010 |
| WO | WO-2013/132218 | 9/2013 |

OTHER PUBLICATIONS

Johnson et al., U.S. Office Action dated Feb. 8, 2018, directed to U.S. Appl. No. 15/043,399; 9 pages.

Stewart, U.S. Office Action dated Feb. 6, 2018, directed to U.S. Appl. No. 15/043,403; 9 pages.

Peet et al., U.S. Office Action dated Jan. 25, 2018, directed to U.S. Appl. No. 15/043,410; 11 pages.

Stewart et al., U.S. Office Action dated Feb. 23, 2018, directed to U.S. Appl. No. 15/043,424; 12 pages.

Barclay, U.S. Office Action dated Feb. 28, 2018, directed to U.S. Appl. No. 15/043,431; 11 pages.

Barclay, U.S. Office Action dated Aug. 9, 2018, directed to U.S. Appl. No. 15/043,431; 11 pages.

* cited by examiner

FAN

REFERENCE TO RELATED APPLICATIONS

This application claims the priority of United Kingdom Application No. 1502480.5, filed Feb. 13, 2015, the entire contents of which are incorporated herein by reference.

FIELD OF THE INVENTION

The present invention relates to a fan. Particularly, but not exclusively, the present invention relates to a floor or table-top fan, such as a desk, tower or pedestal fan.

BACKGROUND OF THE INVENTION

A conventional domestic fan typically includes a set of blades or vanes mounted for rotation about an axis, and drive apparatus for rotating the set of blades to generate an air flow. The movement and circulation of the air flow creates a 'wind chill' or breeze and, as a result, the user experiences a cooling effect as heat is dissipated through convection and evaporation. The blades are generated located within a cage which allows an air flow to pass through the housing while preventing users from coming into contact with the rotating blades during use of the fan.

WO 2009/030879 describes a fan assembly which does not use caged blades to project air from the fan assembly. Instead, the fan assembly comprises a cylindrical base which houses a motor-driven impeller for drawing a primary air flow into the base, and an annular nozzle connected to the base and comprising an annular air outlet through which the primary air flow is emitted from the fan. The nozzle defines a central opening through which air in the local environment of the fan assembly is drawn by the primary air flow emitted from the mouth, amplifying the primary air flow.

WO 2010/100452 also describes a similar fan assembly. Within the base, the impeller is located within an impeller housing, and the motor for driving the impeller is located within a motor bucket which is mounted on the impeller housing. The impeller housing is supported within the base by a plurality of angularly spaced supports. Each support is, in turn, mounted on a respective support surface extending radially inwardly from the inner surface of the base. In order to provide an air tight seal between the impeller housing and the base, a lip seal is located on an external side surface of the impeller housing for engaging the internal side surface of the base.

WO 2010/046691 also describes a fan assembly. The fan assembly comprises a cylindrical base which houses a motor-driven impeller for drawing a primary air flow into the base, and an annular nozzle connected to the base and comprising an annular air outlet through which the primary air flow is emitted from the fan. The fan assembly comprises a filter for removing particulates from the air flow. The filter may be provided upstream from motor-driven impeller, in which case particulates are removed from the air flow prior to passing through the impeller. This protects the impeller from debris and dust that may be drawn into the fan assembly and which may damage the fan assembly. Alternatively, the filter may be provided downstream from the motor-driven impeller. In this configuration it is possible to filter and clean the air drawn through the motor-driven impeller, including any exhaust emissions, prior to progression through the elements of the fan assembly and supply to the user.

SUMMARY OF THE INVENTION

Described is an improved fan assembly which overcomes some of the disadvantages of the prior art, or at least provides an alternative fan assembly. In a first aspect, the present invention provides a fan assembly comprising a body comprising means for generating an air flow, a nozzle mountable on the body for receiving the air flow from the body and for emitting the air flow, a nozzle retaining means for releasably retaining the nozzle on the body, the nozzle retaining means having a first configuration in which the nozzle is retained on the body and a second configuration in which the nozzle is released for removal from the body, and a manually actuable member located on the nozzle for effecting movement of the nozzle retaining means from the first configuration to the second configuration.

The provision of a manually actuable member for effecting movement of the nozzle retaining means from the first configuration to the second configuration allows the nozzle to be rapidly and easily released for removal from the body. By providing the manually actuable member on the nozzle it is possible to release the nozzle from the body and remove it in a single action, as the manually actuable member is lifted off with the nozzle. Once the nozzle has been released it may be pulled away from the body by a user, for example for cleaning or replacement of the nozzle, or for the cleaning or replacement of another component, such as a filter.

The nozzle retaining means is biased towards the first configuration, such that the nozzle is retained on the body in its normal state. Biasing means is preferably provided for biasing the manually actuable member towards the first position. The biasing means may conveniently be in the form of a compression spring, but other forms of biasing means are also envisaged within the scope of the invention.

The manually actuable member is preferably moveable from a first position to a second position to effect movement of the nozzle retaining means from the first configuration to the second configuration. The manually actuable member is preferably depressible. The manually actuable member may conveniently take the form of one or more buttons which are located on an exterior surface of the nozzle and may conveniently be pressed by a user. In an embodiment of the invention the nozzle may be provided with two diametrically opposed buttons on a base of the nozzle such that a user may grasp the base of the nozzle in both hands and press the buttons with their thumbs while lifting the nozzle from the base. This configuration provides a particularly easy method of removal.

The manually actuable member preferably comprises a seal member to prevent air flow generated by the fan assembly from leaking out during use of the fan. The seal member preferably seals against a surface of the nozzle when the manually actuable member is in its first position.

The nozzle retaining means preferably comprises a detent which is moveable relative to the nozzle and the body to retain the nozzle on the body in the first configuration, and to release the nozzle for removal from the body in the second configuration. The detent of the nozzle retaining means is preferably provided on the nozzle. The detent is preferably moveable from a first position to a second position to release the nozzle for removal from the body.

Preferably the nozzle retaining means comprises biasing means for biasing the detent towards the first position. The biasing means may conveniently be the same biasing means that biases the nozzle retaining means towards its first configuration. Alternatively, an additional biasing means may be provided. Preferably the detent is pivotably moveable relative to the nozzle and the body.

In an embodiment of the invention the manually actuable member and the detent may be formed as a single component, with the manually actuable member being provided at one end and the detent being provided at the other. When this member is pivotably mounted on the nozzle manual pressure on the manually actuable member overcomes the biasing force of the biasing member and causes the manually actuable member and the detent to pivot, such that the detent moves to its second position for removal of the nozzle from the body.

The detent is preferably arranged to engage an outer surface of the body to retain the nozzle on the body. The detent is preferably arranged to engage a recessed portion of the outer surface of the body to retain the nozzle on the body.

The nozzle preferably defines an opening through which air from outside the fan assembly is drawn by the air emitted from the nozzle. The fan assembly preferably comprises a filter upstream from the air inlets.

The user experience is improved with a nozzle which is securely held in place, yet may be quickly and easily removed in a single action. It is desirable to provide a nozzle which may be located on the body just as easily, and so in a second aspect the present invention provides a fan assembly comprising a body comprising an inlet, an outlet and means for generating an air flow through the body, and a nozzle mountable on the body for receiving the air flow from the body and for emitting the air flow, wherein the body and the nozzle have cooperative inclined surfaces configured to assist alignment of the nozzle on the body.

The cooperative inclined surfaces are complementary and configured such that they are able to slide relative to one another when they come into contact and guide the nozzle into the correct position for engagement with the body. The arrangement of the inclined surfaces is such when the body is situated on a surface, such as a floor or table, and the inclined surfaces are caused to slide relative to one another they cause nozzle to rotate relative to the body. This results in a "self twist" docking mechanism for the nozzle on the base which doesn't rely on a user perfectly aligning the nozzle and the body.

The inclined surfaces are preferably undulating. The term "undulating" as used herein describes a sinuous, wave-like surface which has a plurality of peaks and troughs.

Preferably the cooperative inclined surface on the body comprises a top edge of the body. Preferably the cooperative inclined surface on the nozzle comprises a surface located in a channel in a base of the nozzle.

The body is preferably cylindrical, although elliptical shaped bodies will also be able to function in a similar manner.

Preferably the nozzle comprises a nozzle retaining means for retaining the nozzle on the body. An outer surface of the body preferably comprises recesses for receiving a portion of the nozzle retaining means.

The inclined surfaces preferably define opposing pairs of peaks and troughs. The recesses are preferably located on the peaks. The inclined surfaces preferably comprise a pair of diametrically opposed peaks and a pair of diametrically opposed troughs.

The fan assembly preferably comprises a filter upstream from the air inlet, and so in a third aspect the present invention provides a fan assembly comprising a body comprising an air inlet, an air outlet, and means for generating an air flow through the body, a nozzle removably mounted on the body for receiving the air flow from the body and for emitting the air flow, and a filter surrounding at least a portion of the body upstream from the air inlet, the filter being held captive on the fan assembly between the nozzle and a portion of the body while remaining free to move relative to the body and the nozzle, and wherein the filter is removable from the fan assembly only after removal of the nozzle from the body.

The filter is securely held in place when the nozzle is mounted on the body, but it is not connected to either the body or the nozzle. The term "connected" as used herein implies some degree of interlocking, or inter-engagement, and does include the fact that the filter is in contact with the body and the nozzle. The filter may be considered to be loose fitting as it is free to move relative to the body and nozzle. The filter may simply be lowered onto the body and then secured in place by the engagement of the nozzle with the base. There is no need to make any connection between the filter and the body, other than lowering the filter into place. This provides a convenient and easy way to fit and remove the filter.

The body preferably comprises a seat for the supporting the filter. Preferably the seat comprises an upwardly facing surface for supporting the filter. Preferably the seat is substantially orthogonal to a longitudinal axis of the body.

The body preferably comprises a lower body section and an upper body section and the seat projects outwardly from the upper body section. The means for generating the air flow through the body may conveniently be located within the upper body section, and a control circuit for controlling the means for generating the air flow may conveniently be located within the lower body section. The lower body section preferably also comprises means for rotating the upper body section relative to the lower body section. The means for rotating the upper body preferably comprises an oscillation mechanism for oscillating the upper body back and forth relative to the lower body.

Preferably the diameter of the lower body section is larger than the diameter of the upper body section. An outer edge of the seat is preferably substantially flush with an outer surface of the lower body section. When the filter is located on the body it preferably rests on the on the seat and an outer surface of the filter is preferably substantially flush with an outer surface of the lower body section.

The fan assembly preferably further comprises sealing means for forming a seal between the filter and at least the body to define a flow path between a downstream surface of the filter and the air inlet of the body.

Sealing means is preferably provided for forming a seal between a filter other components of the fan assembly, and so in a fourth aspect the present invention provides a fan assembly comprising a body comprising an air inlet, an air outlet, and means for generating an air flow through the body, a nozzle for receiving the air flow from the body and for emitting the air flow, a filter upstream from the air inlet and having an upstream surface and a downstream surface, a seat on the body having an upwardly facing surface for supporting the filter, and sealing means for forming a seal between the filter and the body to define a flow path between the downstream surface of the filter and the air inlet.

It is important to ensure that all of the air entering the body has passed through the filter. This facilitates the removal of particulate matter from the air flow entering the body, which is beneficial for both the internal workings of the fan assembly and ensures that the air flow emitted from the nozzle is free from particulate matter. This enables impurities to be removed from the air in the space in which the fan is located. In order to effectively do this it is important to ensure that all of the air entering the body has passed through the filter. This is achieved by providing the sealing means which define a flow path between a downstream surface of the filter and the air inlet of the body. When the fan assembly draws air into the body it is drawn through the filter.

Preferably the sealing means comprises at least one sealing member provided on the nozzle. Preferably the sealing means comprises at least one sealing member provided on the body. Preferably the sealing means comprises a first sealing member provided on the body and a second sealing member provided on the nozzle. Preferably the sealing means comprises at least one sealing member provided on the filter. More preferably the filter is provided with at least two sealing members.

The filter is preferably supported on a seat which extends substantially orthogonal to a longitudinal axis of the body. Preferably the upwardly facing surface is inclined downwardly away from a longitudinal axis of the body. A lower seal member is preferably provided adjacent the seat for forming a seal against a bottom surface of the filter. An upper seal member is preferably provided on the nozzle for forming a seal against an upper surface of the filter. The sealing means are preferably annular.

It is desirable that a filter is provided upstream of the air inlets, and so in a fifth aspect the present invention provides a fan assembly comprising a body comprising an air inlet, an air outlet, and means for generating an air flow through the body, the body having a lower body section and an upper body section capable of rotation relative to the lower body section, a nozzle for receiving the air flow from the body and for emitting the air flow, a filter upstream from the air inlet, and a seat on the upper body section for supporting the filter such that the filter rotates relative to the lower body section when the upper body section is caused to rotate, wherein the seat has an upwardly facing surface for supporting the filter.

Since the upper body is rotatable relative to the lower body it is advantageous for the filter to be supported by a seat on the upper body section. In order for the filter to function properly it needs to be sealed to the fan assembly in order to define a flow path between a downstream surface of the filter and the air inlet of the body. Preferably the seat is provided with a seal for forming a sealing engagement with the filter. With the filter supported on the upper body section it is able to rotate with the upper body section and the seals are not disturbed. However, if the filter was supported on the lower body section then at least one of its seals would drag against the body when the upper body section was rotated. This is undesirable as it increases the likelihood of air leaking around and bypassing the filter.

The seat is preferably substantially orthogonal to a longitudinal axis of the upper body section. Preferably the lower body section and upper body section are cylindrical and the seat projects radially from the upper body section. Preferably the diameter of the lower body section is larger than the diameter of the upper body section. Other shapes for the upper and lower body sections are also envisaged, for example, they may be square, rectangular, triangular, or any other regular or irregular shape. It is preferred that the outer edges of the lower body section extend beyond those of the upper body section.

Preferably the seat projects radially from the upper body section. Preferably an outer edge of the seat is substantially flush with an outer surface of the lower body section.

The lower body section preferably comprises means for rotating the upper body section relative to the lower body section. Preferably the means for rotating the upper body section comprises an oscillation mechanism.

The filter is preferably tubular and surrounds at least a portion of the body. Preferably the filter extends 360° around the body. Alternatively, the filter may preferably extend radially around at least a portion of the body.

When the filter is on the seat an outer surface of the filter is preferably substantially flush with an outer surface of the lower body section. This provides a more aesthetically pleasing product as the filter and lower body section have a sleek profile. It is further preferred that when the nozzle is mounted on the body an outer surface of the filter is substantially flush with an outer surface of a base portion of the nozzle. Again, this helps to integrate the filter into the fan assembly and provides a more visually appealing appearance as the filter and the lower body section form a contiguous outer surface.

Preferably the seat comprises a first section which extends substantially perpendicular to a longitudinal axis of the upper body section and a second section which is inclined downwardly relative to the longitudinal axis. The filter preferably comprises a plurality of wedge-shaped projections on a lower surface. The wedge-shaped projections are preferably angularly spaced around the periphery of the filter. The wedge-shaped projections preferably taper upwardly and inwardly from an outer edge of the filter towards the longitudinal axis. When the filter is placed onto the body the wedge-shaped projections cooperate with the inclined surface of the seat to centre the filter on the body. The cooperating surfaces of the wedge-shaped projections and the inclined surfaces slide relative to one another such that the filter is effectively able to self-centre on the body in a position substantially parallel to a surface on which a base of the body is situated.

The filter preferably comprises a filter media comprising a HEPA filter. The filter preferably comprises a filter media comprising an activated carbon cloth filter. The filter media may preferably be pleated in order to increase the available surface area of the filter media. The filter preferably comprises a perforated shroud surrounding a filter media of the filter. The shroud serves to protect the filter media from damage, e.g. during transit, and it also comprises apertures which are sized to prevent larger particles from coming into contact with the filter media. In addition, the shroud provides an attractive outer surface for the filter, which complements the body and nozzle of the fan assembly.

The fan assembly is preferably provided with a seat for supporting the filter, and so in a sixth aspect the present invention provides a fan assembly comprising a body comprising an air inlet, an air outlet, and means for generating an air flow through the body, a nozzle for receiving the air flow from the body and for emitting the air flow, and a filter upstream from the air inlet, and a seat on the body, the seat comprising an upwardly facing surface for supporting the filter.

Preferably the seat is substantially orthogonal to a longitudinal axis of the body.

Preferably the body is cylindrical. Preferably the seat projects radially from the body. Preferably the upwardly facing surface is inclined downwardly away from a longitudinal axis of the body.

Preferably the seat comprises a first section which projects radially from the body substantially perpendicular to the longitudinal axis and a second section which is inclined downwardly away from the longitudinal axis. Preferably the body comprises a lower body section and an upper body section and the seat projects radially outwardly from the upper body section.

Preferably the diameter of the lower body section is larger than the diameter of the upper body section. Preferably an outer edge of the seat is substantially flush with an outer surface of the lower body section. When the filter is on the seat an outer surface of the filter is preferably substantially flush with an outer surface of the lower body section.

The lower body section preferably comprises means for rotating the upper body section relative to the lower body section. Preferably the means for rotating the upper body section comprises an oscillation mechanism.

The filter preferably comprises a plurality of wedge-shaped projections on a lower surface. The wedge-shaped projections preferably taper upwardly and inwardly from an outer edge of the filter towards the longitudinal axis. The wedge-shaped projections are preferably angularly spaced around the periphery of the filter. When the filter is placed onto the body the wedge-shaped projections cooperate with the inclined surface of the seat to centre the filter on the body. The cooperating surfaces of the wedge-shaped projections and the inclined surfaces slide relative to one another such that the filter is effectively able to self-centre on the body in a position substantially parallel to a surface on which a base of the body is situated.

In a seventh aspect the invention provides a fan assembly comprising a body comprising an air inlet, an air outlet, and means for generating an air flow through the body, the body comprising a lower body section and an upper body section, the upper body section housing the means for generating the air flow and the lower body section housing a control circuit for controlling the means for generating the air flow, and a nozzle for receiving the air flow from the body and for emitting the air flow, wherein the lower body section comprises an outer wall and an inner wall, the outer wall and inner wall defining an outer cavity surrounding an inner cavity, and wherein the control circuit is located within the inner cavity surrounded by the inner wall.

Providing the control circuit within an inner cavity of the lower body section provides protection for the various elements of the control circuit against damage caused by the ingress of fluid, e.g. water, into the fan assembly. If fluid comes into contact with the fan assembly, e.g. as a result of a spillage, it is likely to run off the outer surfaces of the fan assembly. However, if the fluid does manage to penetrate into the lower body of the fan assembly it will be collected within the outer cavity where it cannot come into contact with any of the elements of the control circuit.

Preferably the outer cavity comprises a floor surface located between the outer wall and the inner wall. Preferably the floor surface comprises a plurality of drain holes. The drain holes provide a pathway for fluid to exit the outer cavity, thus preventing the outer cavity from becoming full and overflowing. Preferably the drain holes are angularly spaced about the outer cavity.

Preferably the floor surface is inclined downwardly from the inner wall towards the outer wall. Preferably the drain holes are located adjacent the outer wall. This arrangement aids drainage by directing any fluid in the outer cavity towards the drain holes.

Preferably the outer wall and the inner wall are annular. The inner wall is preferably taller the outer wall. Preferably a top edge of the inner wall terminates adjacent a lower surface of the upper body section.

Preferably a passageway is provided from an inner surface of the inner wall to an outer surface of the outer wall for conveying a power supply cable from the control circuit. A sealing member for sealing the power supply cable to the passageway to prevent the ingress of fluid into the inner cavity is preferably provided.

Preferably a bottom surface of the body is provided with a plurality of feet for supporting the fan assembly. The feet serve to raise the bottom surface above the surface upon which the fan assembly is being supported, e.g. a floor surface or the surface of a table. This ensures that the outlet from the drain holes does not become blocked by the support surface and fluid is able to flow freely from the outer cavity through the drain holes.

Preferably a filter is provided surrounding at least a portion of the body upstream from the air inlet.

The fan assembly preferably comprises means for rotating the upper body relative to the lower body. The means for rotating the upper body preferably comprises an oscillation mechanism. Preferably the means for rotating the upper body section is located within the outer cavity of the lower body section. As with the control circuit, this provides protection for the rotation means from damage caused by the ingress of fluids into the lower body section.

Features described above in connection with the first aspect of the invention are equally applicable to each of the second to seventh aspects of the invention, and vice versa.

BRIEF DESCRIPTION OF THE DRAWINGS

Preferred features of the invention will now be described, by way of example only, with reference to the accompanying drawings, in which.

DETAILED DESCRIPTION OF THE INVENTION

Figure 1:
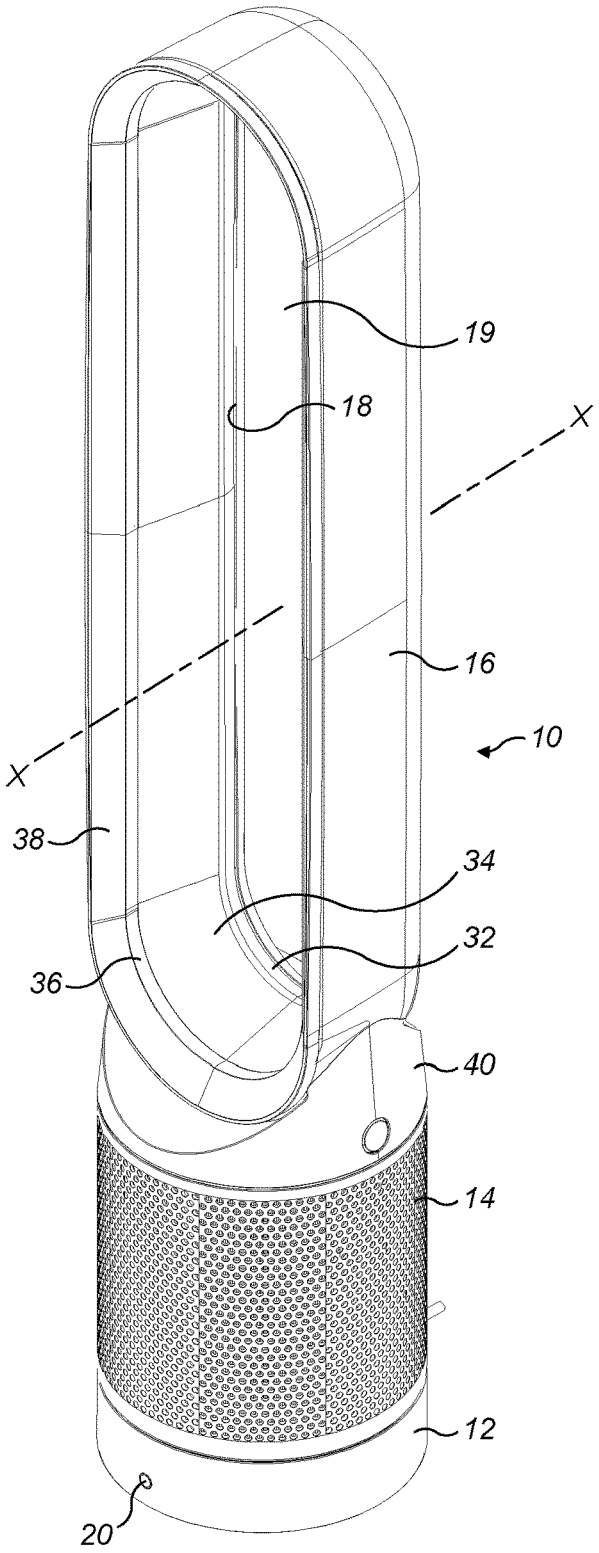
FIG. 1 is a front perspective view of a fan.
Figure 2:
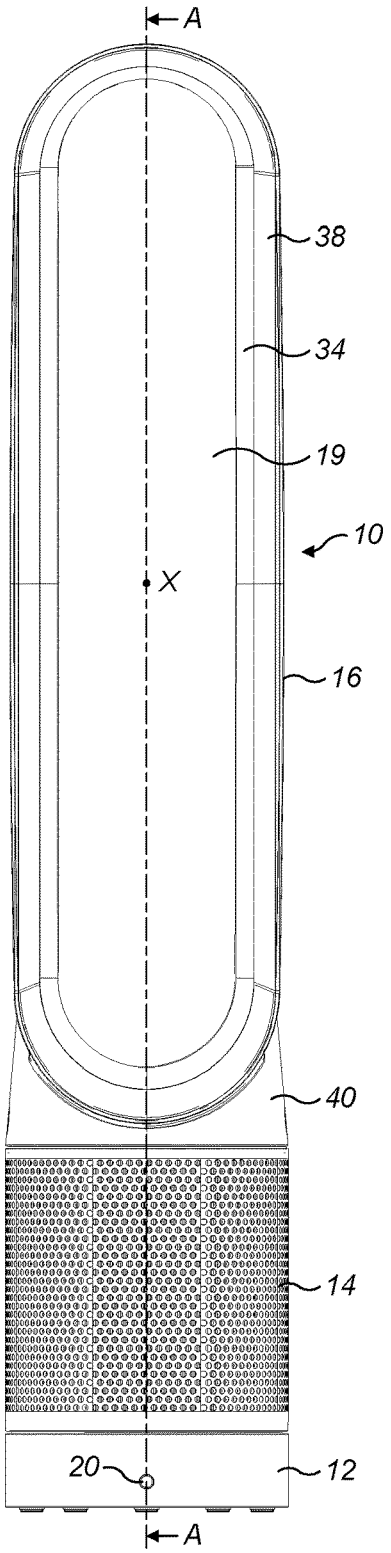
FIG. 2 is a front view of the fan.
Figure 3:
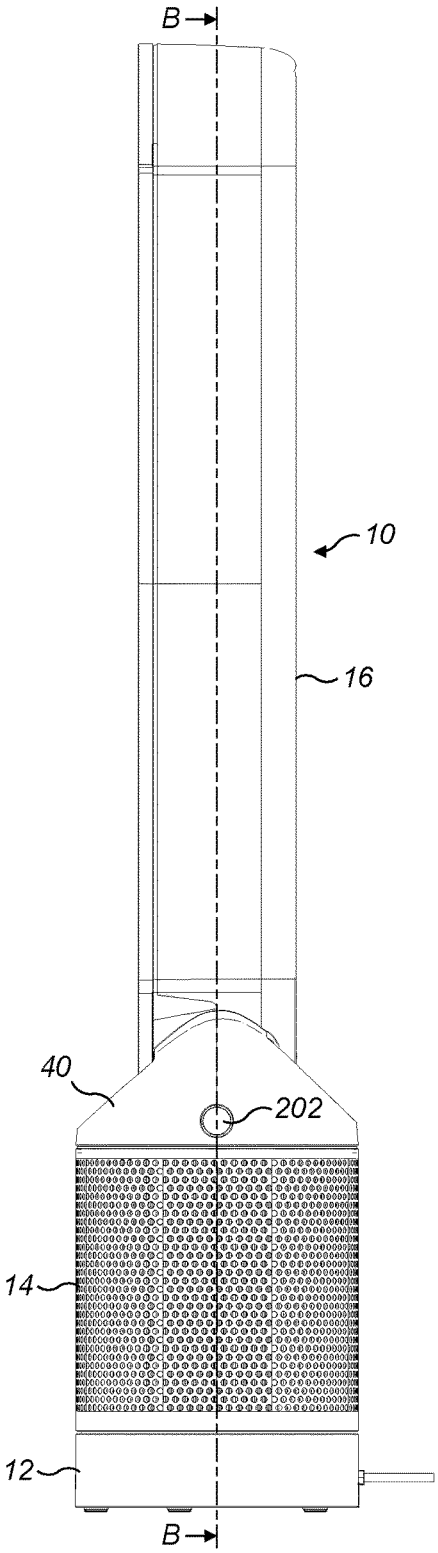
FIG. 3 is a side view of the fan.
Figure 4:
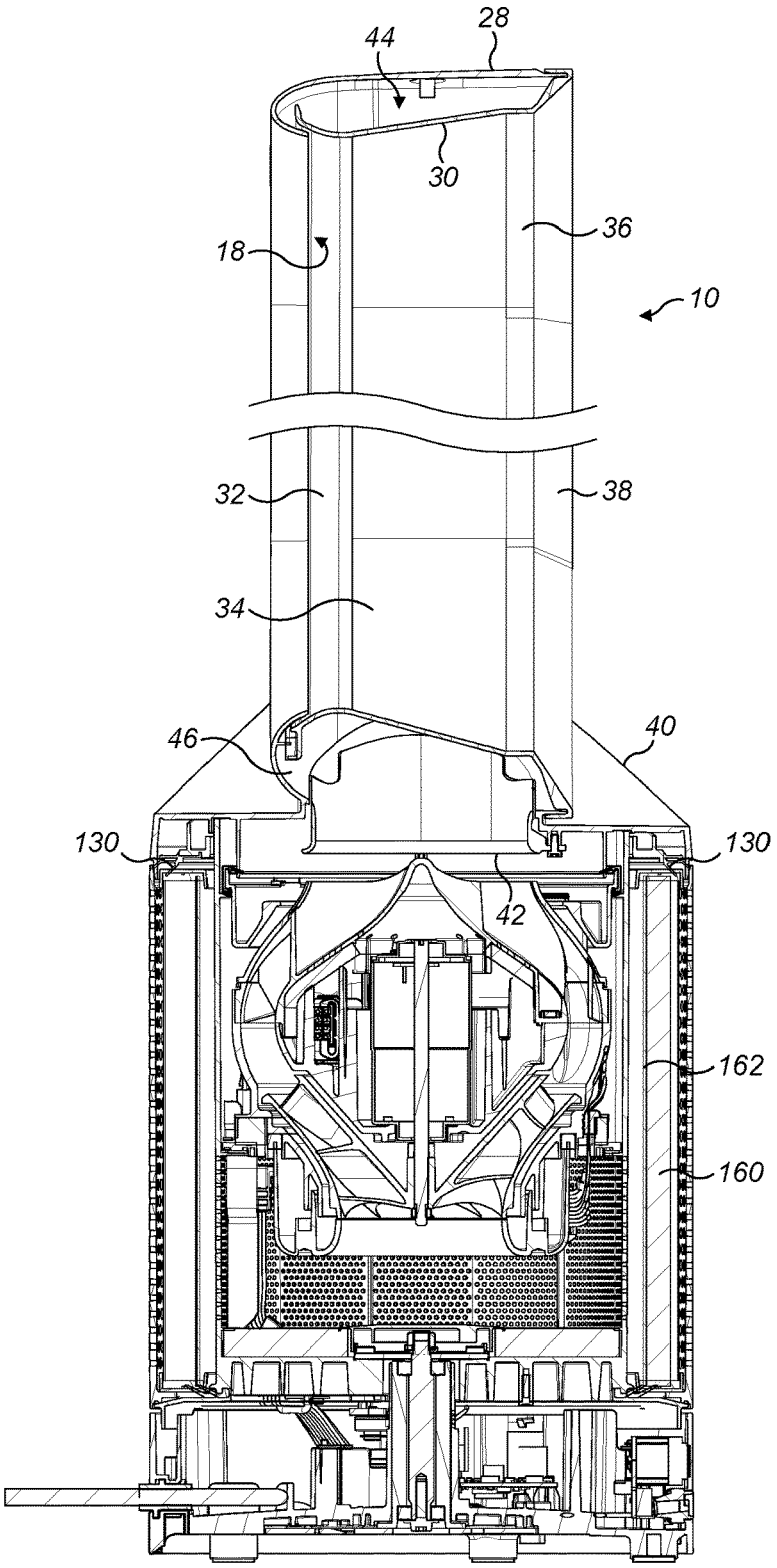
FIG. 4 is a side sectional view through the fan taken along line A-A in FIG. 2.

FIGS. 1 to 3 are external views of a fan 10, and FIGS. 4 and 5 show sectional views through lines A-A and B-B of FIGS. 2 and 3 respectively. In FIGS. 4 and 5 the top portion of the nozzle has been omitted in order to improve the clarity of the remainder of the fan 10. In overview, the fan comprises a body 12, a removable filter 14 mounted on the body 12, and an annular nozzle 16 mounted on the body 12. The filter 14 rests on an annular flange 54 extending radially outwardly from the body 12, and its removal from the body is prevented by the presence of the nozzle 16. In order to remove the filter 14 from the fan 10 the nozzle 16 must first be removed.

The annular nozzle 16 has an air outlet 18 for emitting a primary air flow from the fan 10 and defines a bore 19, or opening, through which air from outside of the fan assembly 10 is drawn by the air emitted from the outlet 18. The body 12 further comprises a user interface for allowing a user to control the operation of the fan 10. The user interface comprises a user-operable button 20 to enable a user to operate the fan 10. The fan 10 may also be provided with a remote control unit for controlling the operation of the fan 10. The remote control unit may be provided with a plurality of user-operable buttons and may advantageously be mounted on the nozzle 16 when not in use. A variety of mounting mechanisms are envisaged, but in one embodiment the remote control unit may be provide with a magnet for attaching to a corresponding magnet housed within the nozzle 16.

The nozzle 16 has an elongate annular shape. The nozzle 16 comprises an outer wall 28 extending about an annular inner wall 30. In this example, each of the walls 28, 30 is formed from a separate component. Each of the walls 28, 30 has a front end and a rear end. The rear end of the outer wall 28 curves inwardly towards the rear end of the inner wall 30 to define a rear end of the nozzle 16. The front end of the inner wall 30 is folded outwardly towards the front end of the outer wall 28 to define a front end of the nozzle 16. The front end of the outer wall 28 is inserted into a slot located at the front end of the inner wall 30, and is connected to the inner wall 30 using an adhesive introduced to the slot. The inner wall 30 extends about an axis X to define the bore 19 of the nozzle 16.

The inner wall 30 is shaped so that the external surface of the inner wall 30, that is, the surface that defines the bore 19, has a number of sections. The external surface of the inner wall 30 has a convex Coanda surface 32 located adjacent the mouth 18 and over which the mouth 18 directs the air emitted from the fan 10, a diffuser surface 34 located downstream of the Coanda surface 32 and a guide surface 36 located downstream of the diffuser surface 34. The diffuser surface 34 is arranged to taper away from the central axis X of the opening 19 in such a way so as to assist the flow of air emitted from the fan 10. A visually appealing tapered surface 38 is located downstream from the guide surface 36.

The rear end of the outer wall 28 is shaped to overlap the rear end of the inner wall 30 to define the air outlet 18, or mouth, of the nozzle 16 between the inner surface of the outer wall 28 and the outer surface of the inner wall 30. The air outlet 18 is in the form of a slot with a width which is preferably substantially constant about the axis X, and is in the range from 0.5 to 5 mm. The overlapping portions of the outer wall 28 and the inner wall 30 are substantially parallel, and are arranged to direct air over the Coanda surface 32 of the inner wall 30.

The outer wall 28 and the inner wall 30 define an interior passage 44 for conveying air to the air outlet 18. The interior passage 44 extends about the bore 19 of the nozzle 16. The nozzle 16 further comprises two curved seal members 112 each for forming a seal between the outer wall 28 and the inner wall 30 at the top and bottom curved sections of the nozzle 16, so that there is substantially no leakage of air from the curved sections of the interior passage 44 of the nozzle 16. The mouth 18 may thus be considered to comprise two elongate outlets each located on a respective long side of the central opening 19.

In order to direct the primary air flow into the mouth 18, the nozzle 16 comprises a plurality of stationary guide vanes 120 located within the interior passage 44 and each for directing a portion of the air flow towards the mouth 18. The guide vanes 120 are integral with the internal surface of the outer wall 28 of the nozzle 16. The guide vanes 120 are curved so that there is no significant loss in the velocity of the air flow as it is directed into the mouth 18. The guide vanes 120 are substantially vertically aligned and evenly spaced apart to define a plurality of passageways between the guide vanes 120 and through which air is directed into the mouth 18. The even spacing of the guide vanes 120 provides a substantially even distribution of the air stream along the length of the section of the mouth 18.

The guide vanes 120 are preferably shaped so that a portion of each guide vane 120 engages the external surface of the inner wall 30 of the nozzle 16 so as to urge apart the overlapping portions of the internal surface of the outer wall 28 and the external surface of the inner wall 30. This can assist in maintaining the width of each outlet at a substantially constant level along the length of each section of the mouth 18. Additional spacers may be provided along the length of each section of the mouth 18, also for urging apart the overlapping portions of the internal surface of the outer wall 28 and the external surface of the inner wall 30, to maintain the width of the outlet 18 at the desired level.

The outer wall 28 comprises a base 40 which is connected to an open upper end of the body 12, and which has an open lower end which provides an air inlet 42 for receiving the primary air flow from the body 12.

The base 40 of the nozzle 16 is provided with a sealing member 130 which extends around the inner periphery of the base 40. The sealing member 130 is an annular rubber seal and is attached to a support member 132 which is located within the base 40 of the nozzle 16. The support member 132 is itself annular and surrounds the air inlet 42 and is attached to the base 40 of the nozzle 16, for example by a plurality of screws.

Figure 6:
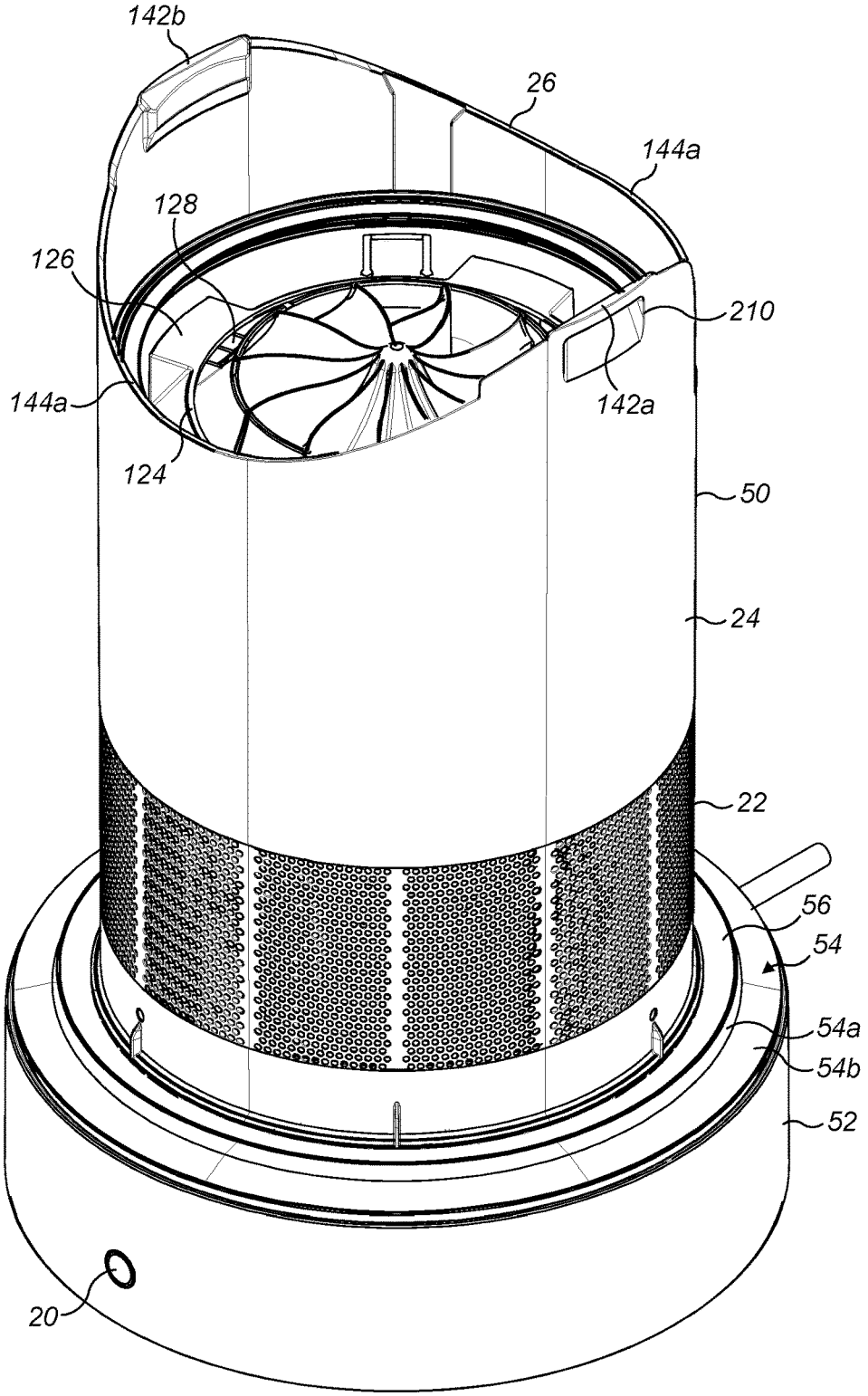
FIG. 6 is a front perspective view of the base of the fan.
Figure 7:
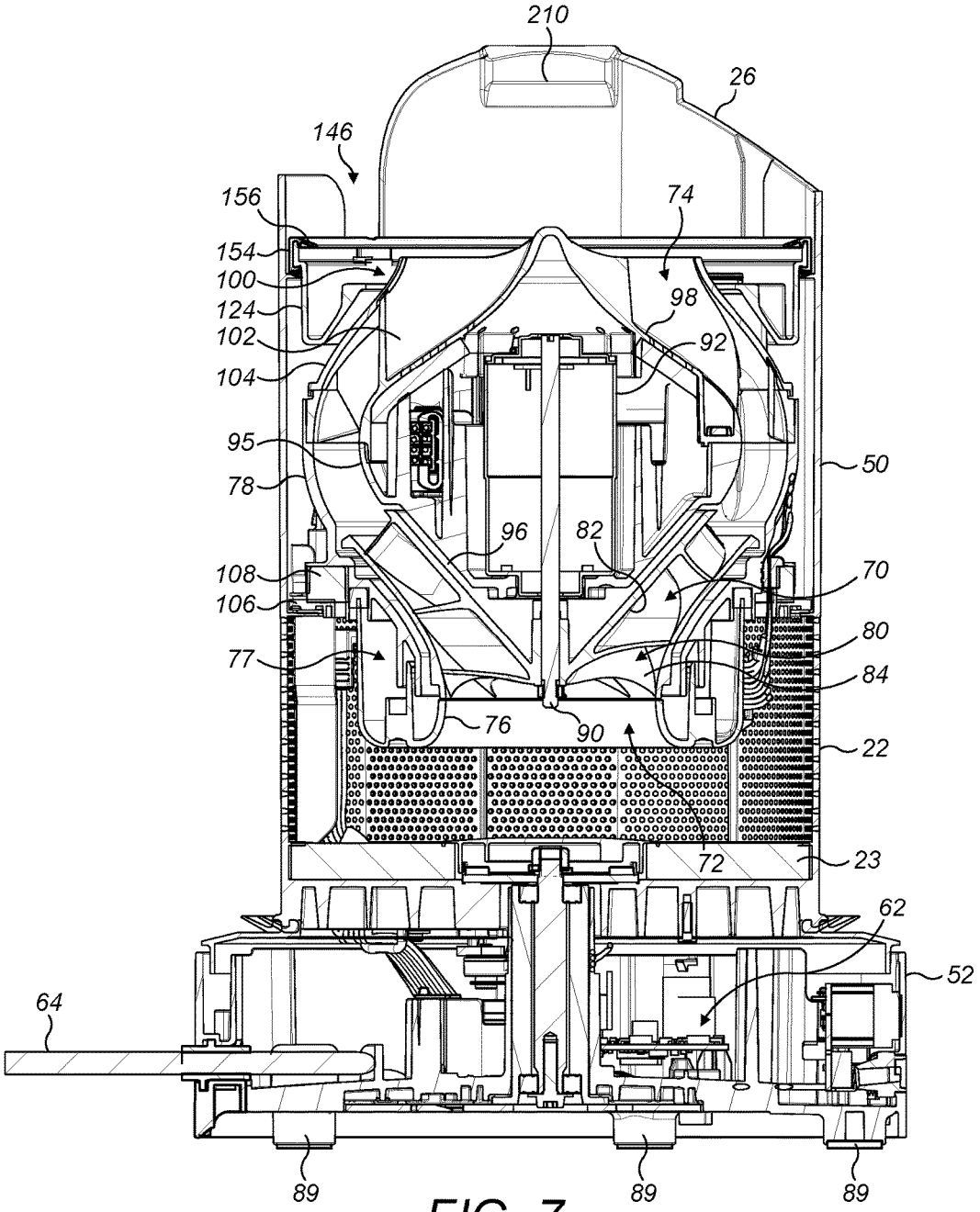
FIG. 7 is a side sectional view of the base of the fan.
Figure 8:
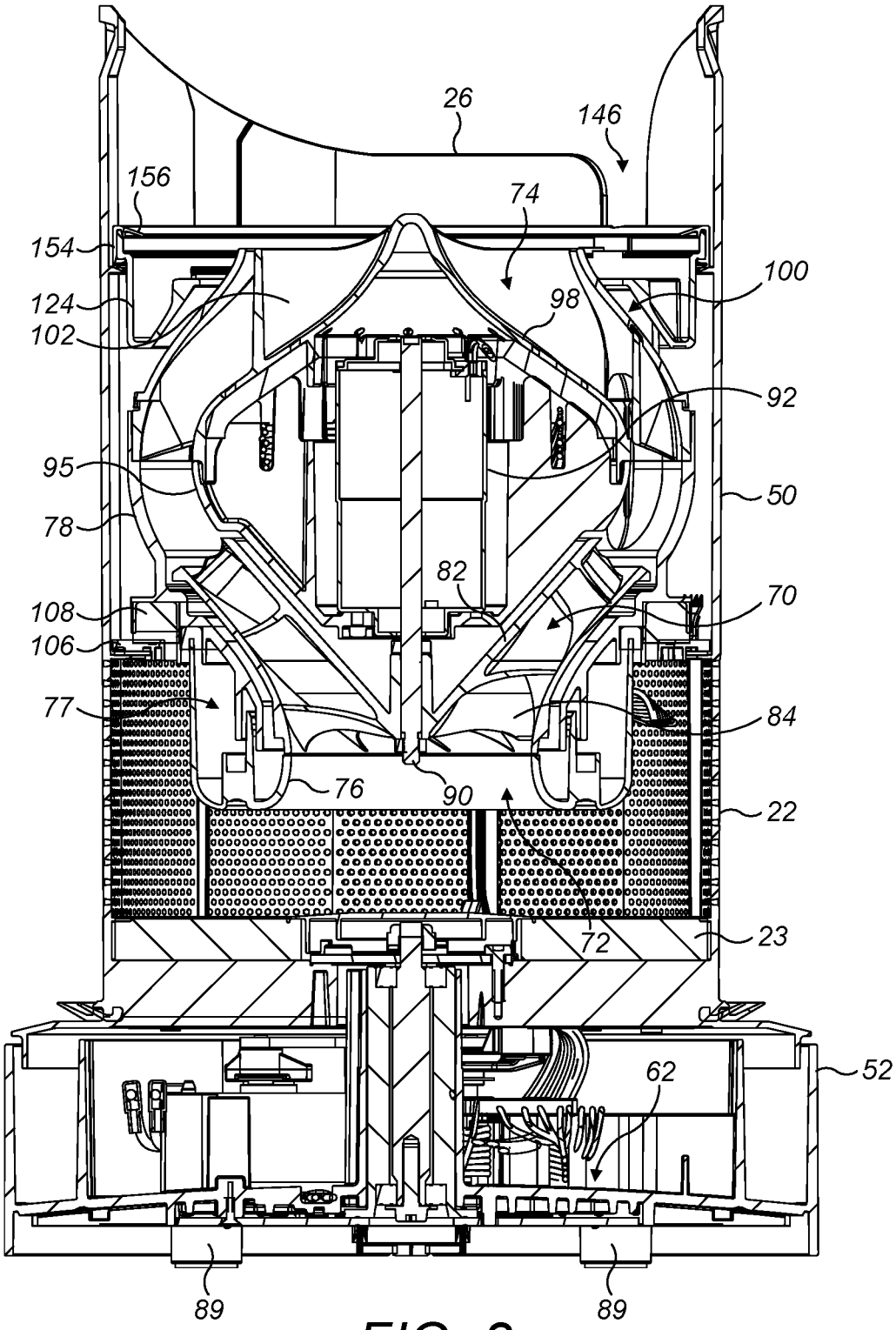
FIG. 8 is a front sectional view of the base of the fan.
Figure 9:
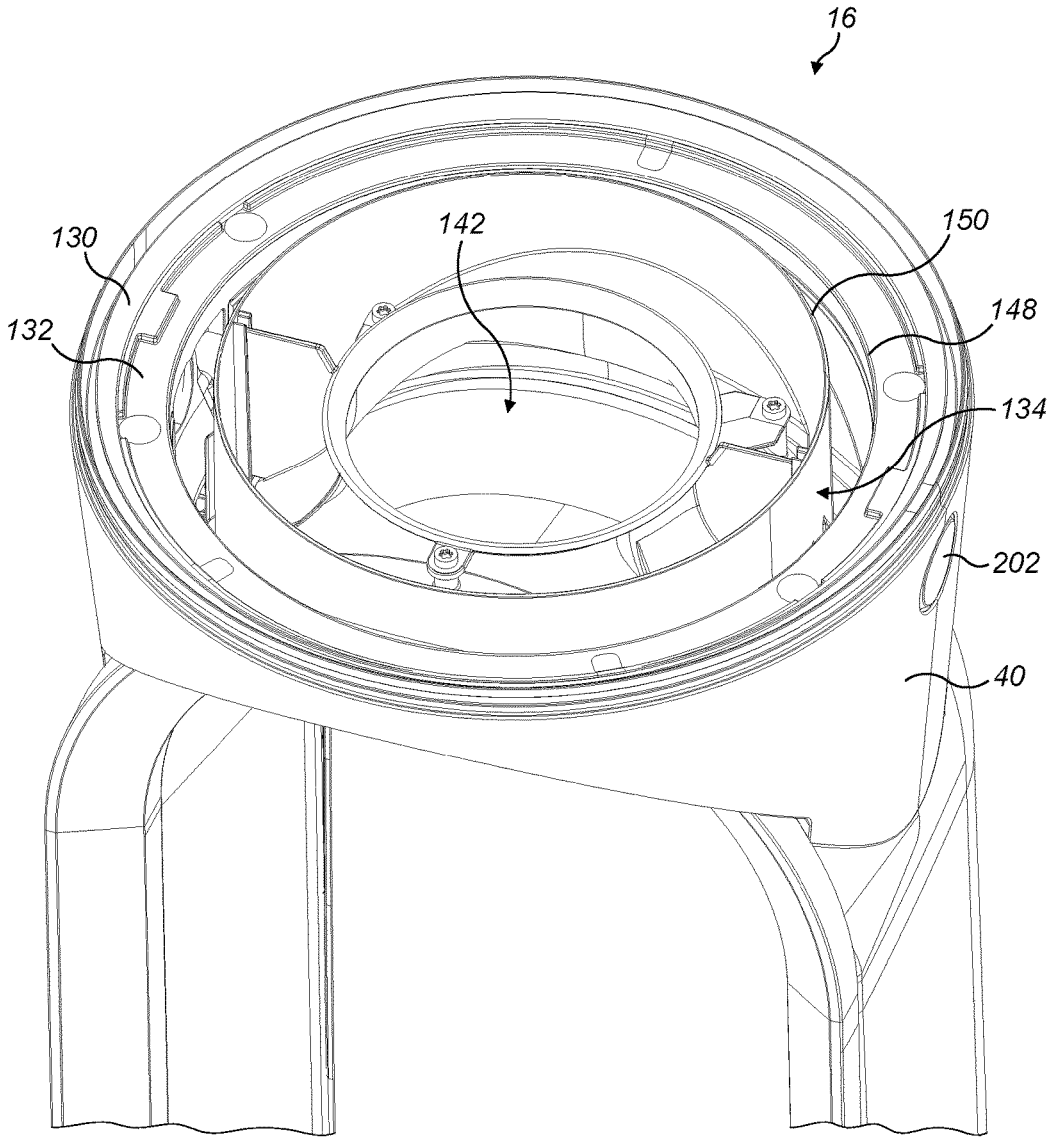
FIG. 9 is a perspective view from below of the nozzle removed from the base.
Figure 10:
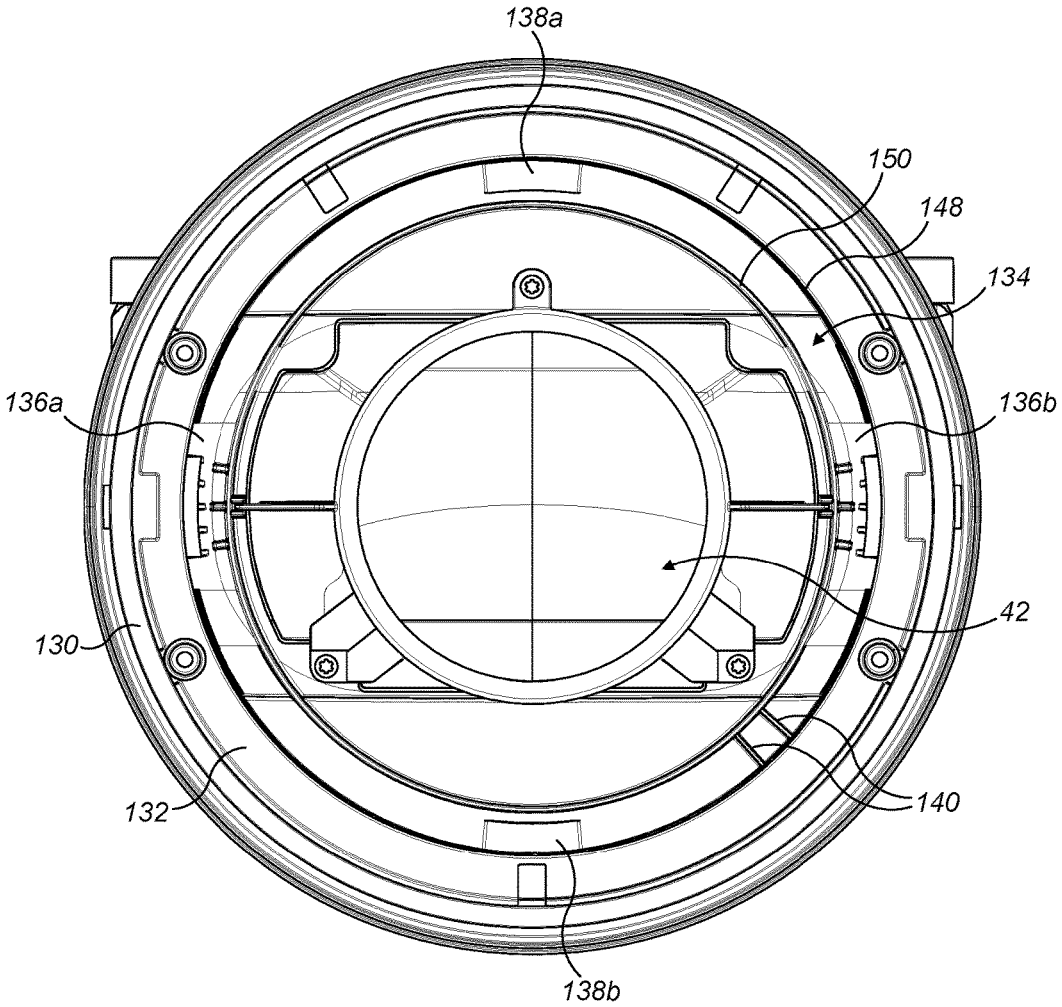
FIG. 10 is bottom view of the nozzle removed from the base.

As can best be seen in FIGS. 6 to 8, the body 12 comprises a substantially cylindrical main body section 50 mounted on a substantially cylindrical lower body section 52. The main body section 50 and the lower body section 52 are preferably formed from plastics material. The main body section 50 has a smaller external diameter than the lower body section 52 and an annular flange 54 extends radially from a lower portion of the main body section 50 such that the outer edge of the annular flange 54 is substantially flush with the external surface of the lower body section 52. The annular flange 54 comprises a first portion **54*a* which extends perpendicularly away from the main body section 50, and a second portion 54*b* which tapers downwardly away from the first portion 54*a*. An annular seal 56 is provided around the main body section 50 at the junction of the main body section 50 and the annular flange 54. The annular seal 56 may conveniently be formed from a rubber material and it is received in an annular groove 58 defined by the first portion 54*a* of the annular flange 54 and an annular rib 60 which extends radially from the main body section 50**.

Figure 5A:
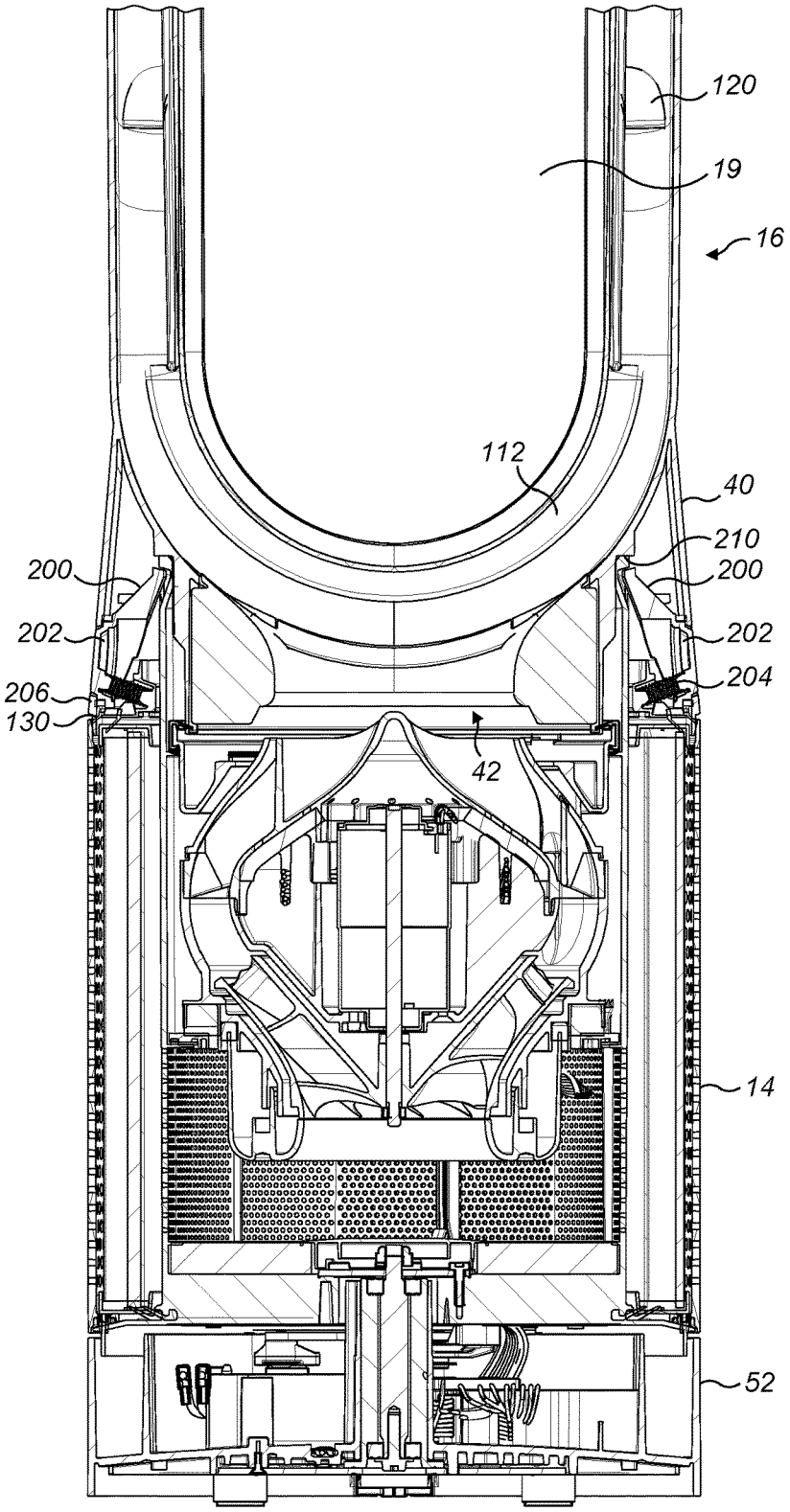
FIG. 5*a* is a front sectional view through the fan taken along line B-B in FIG. 3 with the nozzle engaged on the body.
Figure 5B:
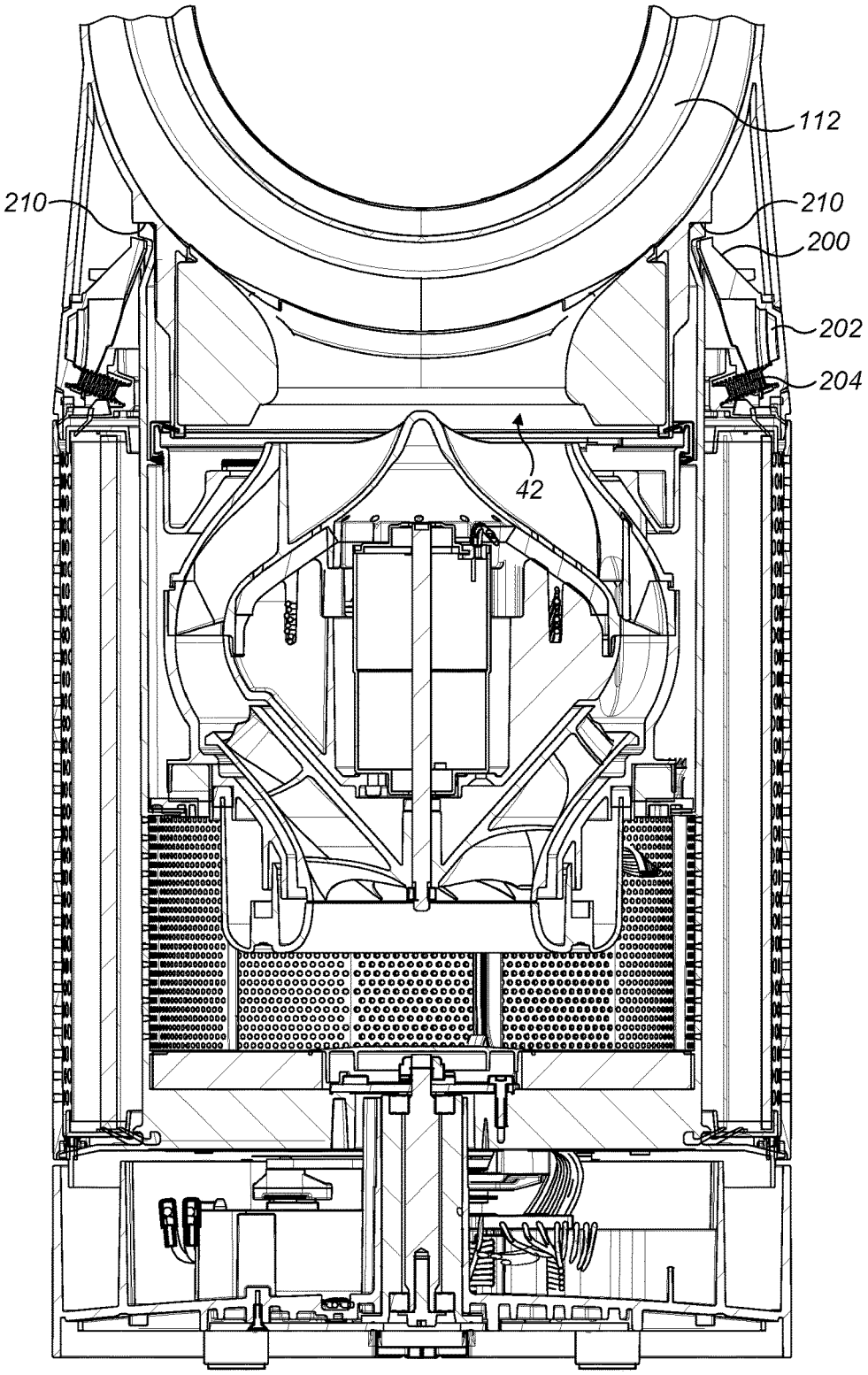
FIG. 5*b* is a front sectional view through the fan taken along line B-B in FIG. 3 with the nozzle released from the body.

The fan 10 comprises a mechanism for releasably retaining the nozzle 16 on the body 12. FIG. **5*a* illustrates a first configuration of the mechanism when the nozzle 16 is retained on the body 12, whereas FIG. 5*b* illustrates a second configuration of the mechanism when the nozzle 16 is released from the body 12. The mechanism for releasably retaining the nozzle 16 on the body 12 comprises a pair of detents 200 which are located on diametrically opposed sides of the nozzle 16. Each detent 200 is pivotably moveable between a deployed position for retaining the nozzle 16 on the body 12, and a stowed position, in which the nozzle 16 can be removed from the body 12. Resilient elements 204, such as compression springs, are located within the nozzle 16 for biasing the detents 200** towards their deployed positions.

The nozzle 16 comprises two diametrically opposed manually actuable buttons 202 which are operable to move the detents 200 between the deployed position, in which the nozzle 16 is retained on the body, and the stowed position, in which the nozzle 16 can be removed from the body 12. The buttons 202 are mounted on the nozzle 16 for pivoting movement from a first position, in which the detents 200 are in their deployed position, to a second position, in which the detents 200 are in their stowed position. The first and second positions of the buttons 202 are shown in FIGS. 5*a* and 5*b* respectively. The buttons 202 are biased into their first position by the resilient elements 204 which are provided behind the buttons 202 and urge them into their first position. The strength of the resilient elements 204 is selected such that the biasing force can be overcome by a user grasping the nozzle 16 and pressing with their fingers. An advantage of providing the buttons 202 on the nozzle 16 is that the nozzle 16 may be quickly and easily released and removed from the body 12 in a single step. A user simply needs to grasp the nozzle 16, depress the buttons 202 and lift the nozzle 16 away from the base 12.

The base 40 of the nozzle 16 comprises two diametrically opposed apertures 206 which have a diameter slightly larger than that of the buttons 202, such that the buttons 202 can project through the apertures 206. Rubber seals 208 are provided surrounding the periphery of the buttons 202, and the seals 208 are urged into sealing engagement with an inner wall of the base 40 surrounding the periphery of the apertures 206 when the buttons 202 are in their first position. This prevents air from flowing out of the apertures 206 during use of the fan 10.

As can best be seen in FIGS. 5*a*, 5*b* and 6, the outer surface of the main body section 50 of the base 12 comprises a pair of diametrically opposed recesses 210. When the detents 200 are in their deployed position they engage the recesses 210 on the outer surface of the main body section 50 of the base 12 to prevent the nozzle 16 from becoming withdrawn from the body 12, for example if the fan apparatus 10 is lifted by a user gripping the nozzle 16. When a user depresses the buttons 202 this moves the detents 200 from their deployed position to their stowed position. In the stowed position the detents 200 are not engaged with the recesses 210, and the nozzle 16 may be removed from the body 12.

Referring now to FIGS. 6 to 10, the base 40 of the nozzle 16 and the main body section 50 of the base 12 comprise complementary features which cooperate to facilitate location of the nozzle 16 on the base 12. The base 40 of the nozzle 16 comprises an annular channel 134 which surrounds the air inlet 42. The annular channel 134 is defined by an outer annular wall 148 and an inner annular wall 150. The outer annular wall 148 and inner annular wall 150 depend downwardly from the nozzle 16 and the inner annular wall 150 extends beyond the outer annular 148, such that it extends into the main body section 50 of the base 12 when the nozzle 16 is located on the base 12. The annular channel 134 has an undulating profile, such that when viewed from below it has two diametrically opposed low points 136*a,b* and two diametrically opposed high points 138*a,b*. The low points 136*a,b* of the annular channel 134 are offset from the high points 138*a,b* such that a line bisecting the low points 136*a,b* is orthogonal to a line bisecting the high points 138*a,b*. The low points 136*a,b* of the annular channel 134 are aligned with the buttons 202 on the nozzle 16. Two ribs 140 extend across the width of the annular channel 134 in a rear half of the nozzle 16 and further serve to aid in the correct fitting of the nozzle 16 on the base 12, as will be described in more detail below.

The main body section 50 of the base 12 comprises an outer casing 24 which defines the side walls of the main body section 12. The main body section 50 is cylindrical and the top edge 26 of the outer casing 24 has an undulating profile, such that it has two diametrically opposed high points 142*a,b* and two diametrically opposed low points 144*a,b*. The high points 142*a,b* of the top edge 26 of the outer casing 24 are offset from the low points 144*a,b* of the top edge 26 of the outer casing 24 such that a line bisecting the high points 142*a,b* is orthogonal to a line bisecting the low points 144*a,b*. As can best be seen in FIG. 10, a locating notch 146 is provided in a rear portion of the outer casing 24 depending downwardly from the top edge 26. The recesses 210 on the outer surface of the outer casing 24 are adjacent the high points 142*a,b* of the top edge 26.

When attaching the nozzle 16 to the base 12 it is important to ensure that nozzle 16 faces in the correct direction. To prevent incorrect attachment of the nozzle 16 to the base 12 the nozzle 16 is provided with ribs 140 which extend across the annular channel 134 in a rear portion of the nozzle 16. The ribs 140 are arranged to be received in the notch 146 which is provided in a rear portion of the top edge 26 of the outer casing 24 to ensure that the nozzle can only be fitted in the correct orientation. If an attempt is made to attach the nozzle 16 in an incorrect position it will be unsuccessful as the ribs 140 will abut the top edge 26 of the outer casing 24 and prevent further insertion of the nozzle 16 into the base 12.

Once care has been taken to ensure that the rear portion of the nozzle 16 is aligned with the rear portion of the base 12 the nozzle 16 be lowered onto the base 12 with the buttons 202 being generally aligned with the detents 200 on the outer surface of the outer casing 24. The undulating top edge 26 of the outer casing 24 is arranged to be received into the annular channel 134 of the base 40 of the nozzle 16. The undulating surfaces of the top edge 26 and the annular channel 134 are complementary such that the high points 142*a,b* of the outer casing 24 are received within the low points 136*a,b* of the outer casing. Similarly, the low points 144*a,b* of the outer casing 24 align with the high points 138*a,b* of the annular channel 134. The complementary nature of the surfaces is such that the undulating top edge 26 of the outer casing 24 is able to slide over the undulating surface of the annular channel 134 until it is received in the correct position. The sliding movement of the top edge 26 relative to the annular channel 134 causes the nozzle 16 to rotate about the longitudinal axis of the nozzle 16 and base 12. This provides a convenient location mechanism which does not rely on the user precisely aligning the nozzle 16 on the base 12.

Referring now to FIGS. 6 to 8, the main body section 50 comprises an air inlet 22 in the form of a plurality of apertures formed in the outer casing 24 of the body 12, and through which a primary air flow is drawn into the body 12 from the external environment. In this embodiment the air inlet 22 comprises an array of apertures formed in the section of the outer casing 24 of the body 12 which is defined by the main body section 50. Alternatively, the air inlet 22 may comprise one or more grilles or meshes mounted within windows formed in the outer casing 24. The main body section 50 is open at the upper end (as illustrated) for connection to the base 40 of the nozzle 16, and to allow the primary air flow to be conveyed from the body 12 to the nozzle 16. A lower surface of the main body section 50, located below the air inlet 22, is lined with noise absorbing material 23, preferably an acoustic foam material, to suppress noise generated during operation of the fan 10.

The lower body section 52 comprises the aforementioned user interface and a control circuit, indicated generally at 62, for controlling various functions of the fan 10 in response to operation of the user interface. The lower body section 52 also houses a mechanism for oscillating the main body section 50 relative to the lower body section 52. The operation of the oscillation mechanism is controlled by the control circuit 62 in response to the user's depression of the appropriate button on the remote control unit. The range of each oscillation cycle of the main body section 50 relative to the lower body section 52 is preferably between 60° and 120°, and the oscillation mechanism is arranged to perform around 3 to 5 oscillation cycles per minute. A mains power cable 64 for supplying electrical power to the fan 10 extends through an aperture formed in the lower body section 52.

Figure 11:
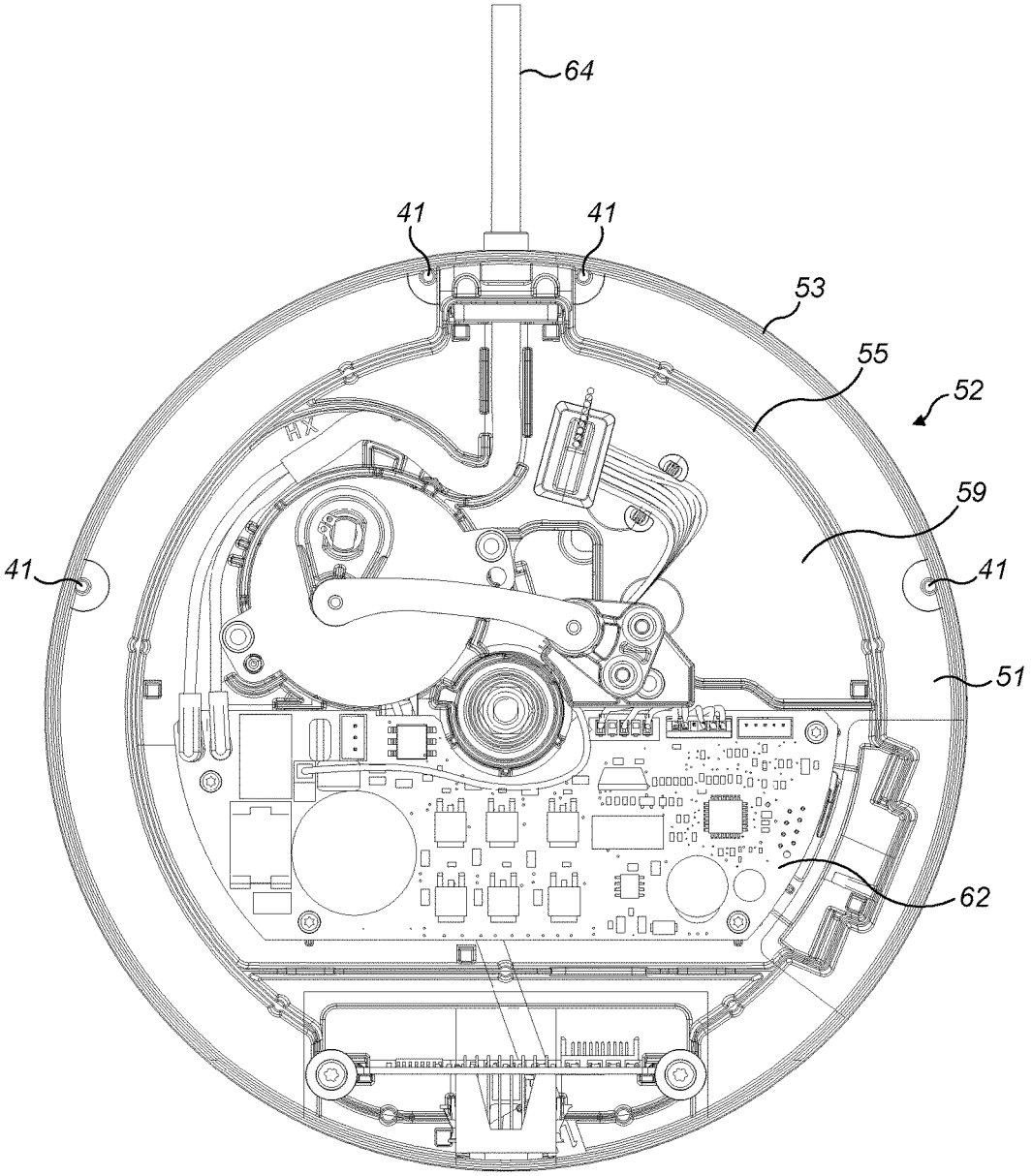
FIG. 11 is a top view of the lower body section of the fan.

Referring now to FIG. 11, it can be seen that the lower body section 52 comprises an outer wall 53, which defines the outer cylindrical surface of the lower body section 52 and an inner wall 55. A first cavity 57 is defined between the outer wall 53 and the inner wall 55. The inner wall is annular and defines an inner cavity 59 which encloses all of the electrical components of the lower body section 52, such as the control circuit 62 and oscillation mechanism. The cavity 57 provides protection for the electrical components of the lower body section 52 in the event of water, or other liquid, ingress into the base 12. If the fan 10 comes into contact with a liquid, e.g. spillage of a beverage, then any water which penetrates the base 12 will be received within the channel 57, and prevented from entering the inner cavity 59 and coming into contact with the electrical components of the lower base section 52, such as the control circuit 62. Drainage holes 41 are provided in a floor surface 43 of the first cavity 57. The drainage holes 41 provide an outlet to permit any water collected in the first cavity to flow out of the lower base section 52 and onto a surface on which the fan assembly 10 is supported. As can best be seen in FIG. 8, the floor surface 43 is inclined outwardly and downwardly away from the longitudinal axis of the lower body section 52 to direct the flow of liquid towards the drainage holes 41. As can best be seen in FIGS. 7 and 8, the lower body section 52 is provided with feet 89 which support the fan assembly on a surface, such as a floor or table. The feet 89 raise the floor surface 43 above the surface on which the fan assembly 10 is supported, to provide a flow path for liquid exiting the drainage holes 41. A passageway 87 is provided through the first cavity 57 to convey the power supply cable 64 away from the control circuit 62. The passageway 87 ensures that the power supply cable 64 does not come into contact with liquid in the first cavity 57 and a seal is provided between the passageway 87 and the power supply cable 64 to prevent liquid ingress.

Figure 12:
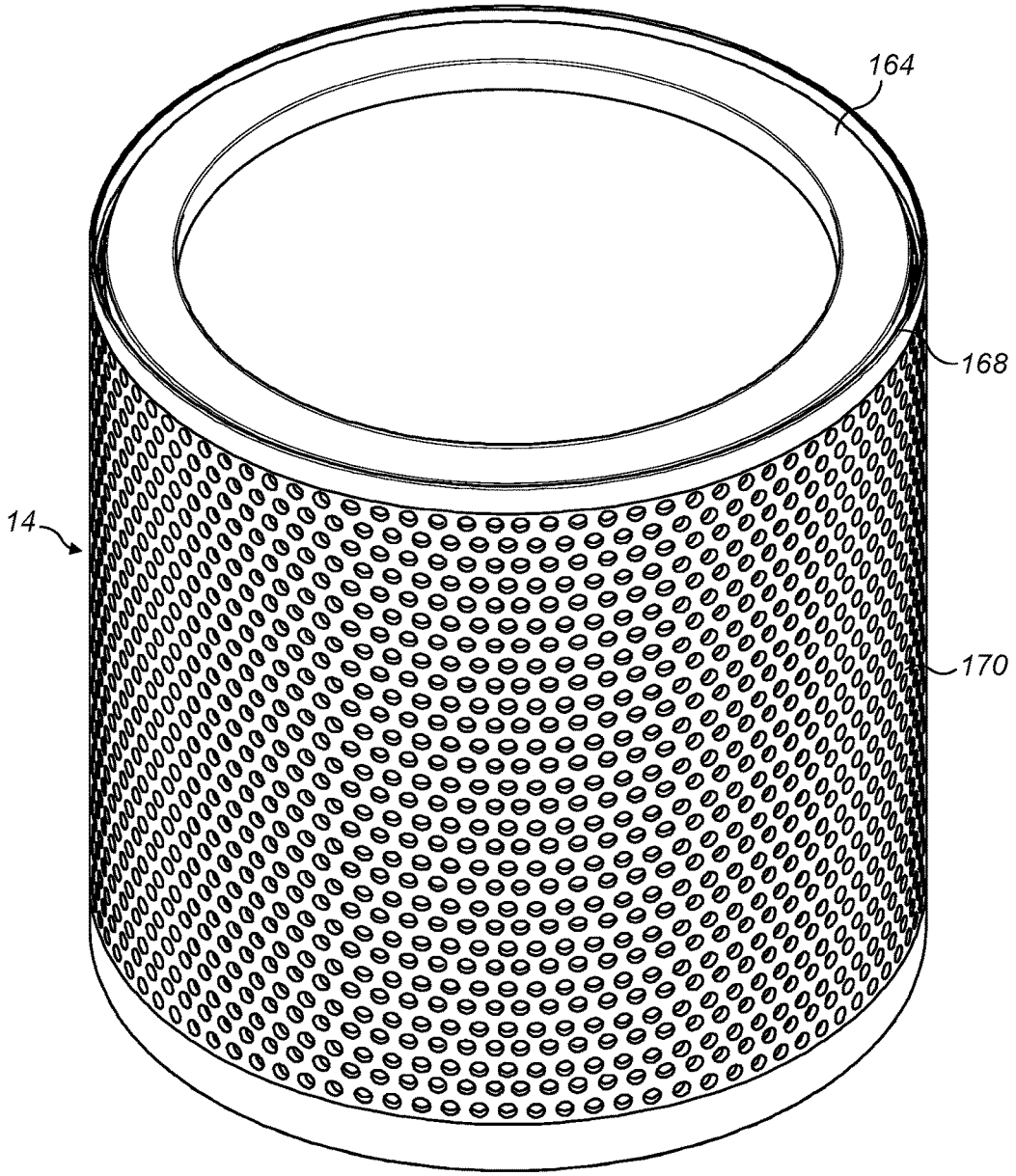
FIG. 12 is a perspective view of the filter removed from the fan.
Figure 13:
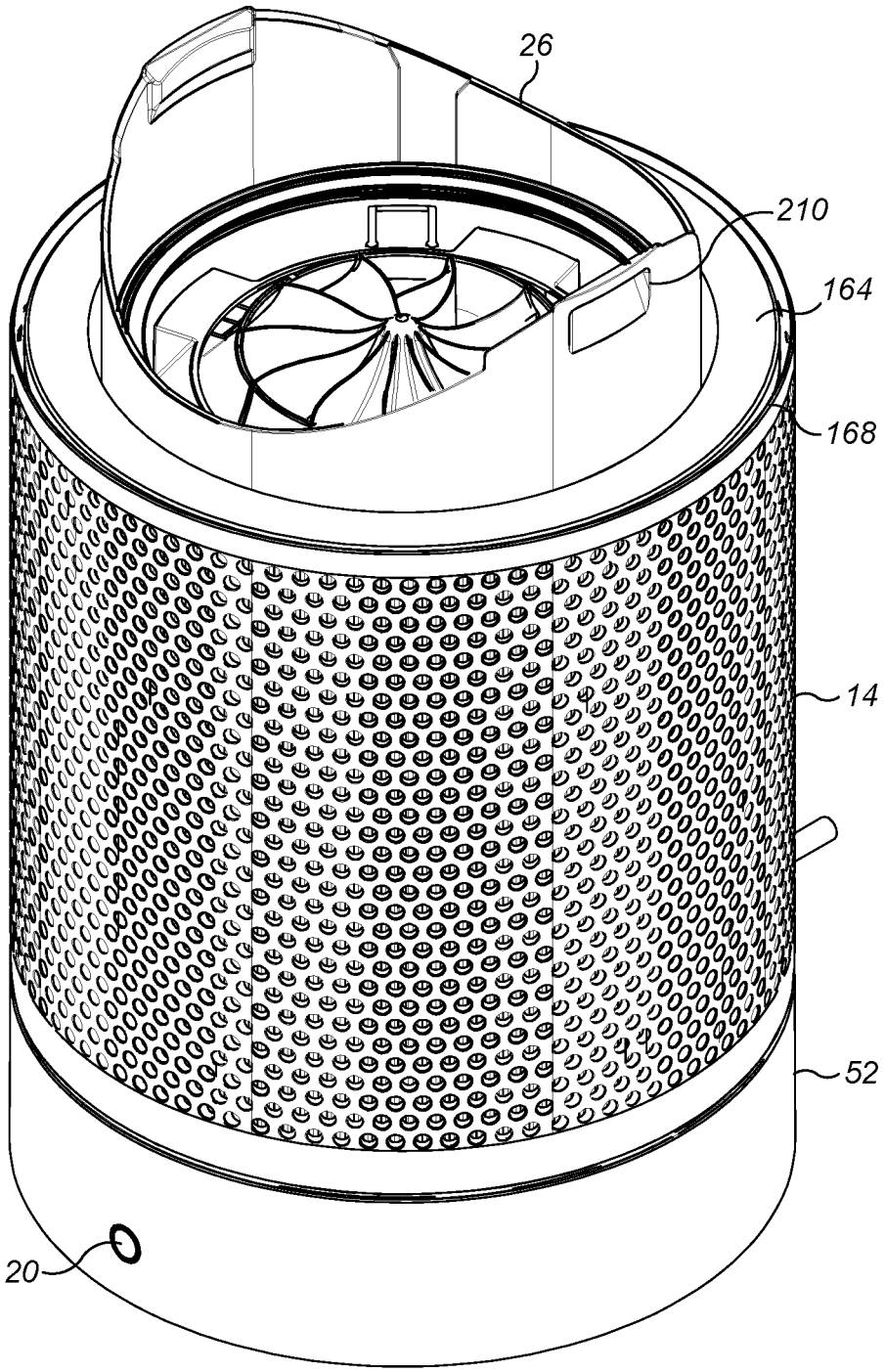
FIG. 13 is a perspective view of the filter on the body of the fan.
Figure 14:
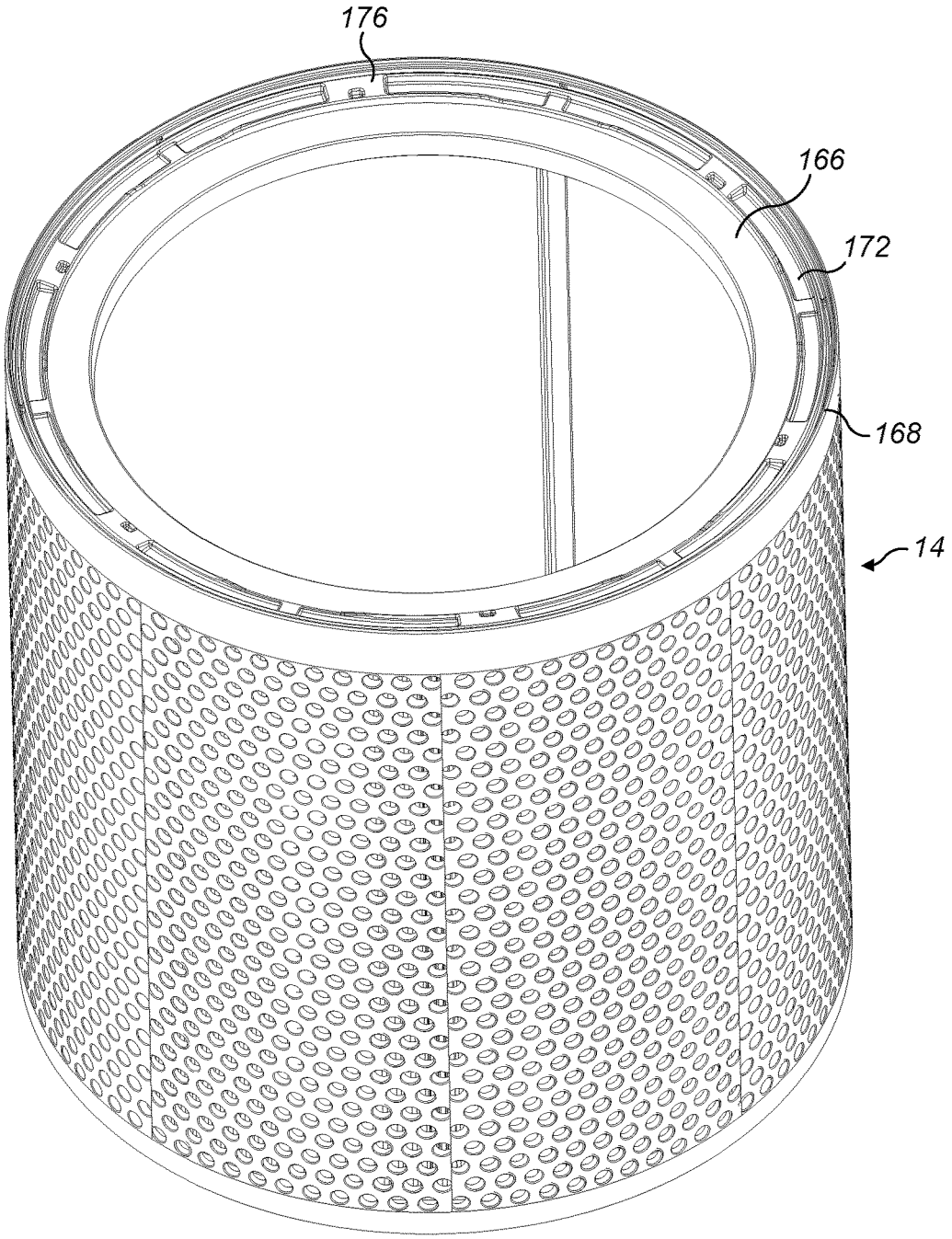
FIG. 14 is a perspective view of the filter from below.

Turning now to FIGS. 12-14, these show the filter 14 according to the present invention. The filter 14 is a tubular, barrel-type filter and comprises a two-layer structure of filter media. Any number of alternative combinations of filter media are envisaged within the scope of the present invention, but filter 14 comprises an outer layer 160 of a pleated HEPA filter surrounding an inner layer 162 of activated carbon cloth. The two layers 160, 162 are encapsulated by top and bottom end caps 164, 166, which are annular members with a generally U-shaped cross section. The filter 14 further comprises a perforated shroud 168 in the form of a tubular plastic member which surrounds the filter media and comprises an array of apertures which act as an air inlet 170 of the filter 14 in use of the fan 10. Alternatively, the air inlet 170 of the shroud 168 may comprise one or more grilles or meshes mounted within windows in the shroud 168. It will also be clear that alternative patterns of air inlet arrays are envisaged within the scope of the present invention.

As can best be seen in FIG. 14, the shroud 168 is connected to the bottom end cap 166 by means of connecting ring 172, which is glued to the shroud 168 and bottom end cap 166 to retain them in a spaced relationship. The shroud 168 protects the filter media from damage, for example during transit, and also provides a visually appealing outer surface for the filter 14, which is in keeping with the overall appearance of the fan 10. The shroud 168 defines the air inlet 170 for the filter 14 and the array of apertures are sized to prevent larger particles from entering the filter 14 and blocking, or otherwise damaging, the filter media.

A lower surface 174 of the connecting ring 172 is provided with a plurality of angularly spaced wedge-shaped projections 176. The wedge-shaped projections 176 are inclined inwardly and upwardly from an outer periphery of the connecting ring 172 towards its longitudinal axis. The filter 14 does not interlock with any other component of the fan 10, and for this reason it may be considered to be loose fitting. When the filter is located on the base 12 of the fan 10 it rests on the annular flange 54 and the wedge-shaped projections 176 cooperate with the tapered second portion **54*b* of the annular flange 54 to help centre the filter 14 on the base 12. The wedges 176 slide over the tapered portion 54*b* until the filter 14 is substantially parallel to the surface on which the fan 10 is sitting. When the oscillation mechanism is activated to cause the main body section 50 to oscillate relative to the lower body section 52 the filter 14 moves with the main body section 50**.

As noted above, when the filter 14 is located on the base 12 of the fan 10 is sits on the annular flange 54. The annular seal 56 forms a seal against the bottom end cap 166 of the filter 14 to prevent leakage of air between the bottom of the filter 14 and the base 12. The filter 14 is located upstream from the air inlets 22 of the main body section 50, such that the air drawn into the main body section 50 by the impeller 80 is filtered prior to entering the main body section 50. This serves to remove any particles which could potentially cause damage to the fan 10, and also ensures that the air emitted from the mouth 18 is free from particulates.

When the nozzle 16 is located on the body 12, as described above, the sealing member 130 on the base 40 of the nozzle 16 forms a seal against the top end cap 164 of the filter 14 to prevent leakage of air between the top of the filter 14 and the nozzle 16. The top and bottom seals to the filter 14 define a flow path, such that all air drawn into the main body section 50 by the impeller 80 must pass through the filter 14.

Referring back to FIGS. 7 and 8, the main body section 50 comprises a duct 70 having a first end defining an air inlet 72 of the duct 70 and a second end located opposite to the first end and defining an air outlet 74 of the duct 70. The duct 70 is aligned within the main body section 50 so that the longitudinal axis of the duct 70 is collinear with the longitudinal axis of the body 12, and so that the air inlet 72 is located beneath the air outlet 74.

The air inlet 72 is defined by an outwardly flared inlet section 76 of an outer wall 77 of the duct 70. The inlet section 76 of the outer wall 77 is connected to an impeller housing 78 of the outer wall 77. The impeller housing 78 extends about an impeller 80 for drawing the primary air flow into the body 12 of the fan 10. The impeller 80 is a mixed flow impeller. The impeller 80 comprises a generally conical hub 82, a plurality of impeller blades 84 connected to the hub 82, and a generally frusto-conical shroud 86 connected to the blades 84 so as to surround the hub 82 and the blades 84. The blades 84 are preferably integral with the hub 82, which is preferably formed from plastics material.

The impeller 80 is connected to a rotary shaft 90 extending outwardly from a motor 92 for driving the impeller 80 to rotate about a rotational axis. The rotational axis is collinear with the longitudinal axis of the duct 70. In this embodiment, the motor 92 is a DC brushless motor having a speed which is variable by the control circuit 62 in response to user selection. The maximum speed of the motor 92 is preferably in the range from 5,000 to 10,000 rpm. The motor 92 is housed within a motor housing. The outer wall 77 of the duct 70 surrounds the motor housing, which provides an inner wall 95 of the duct 70. The walls 77, 95 of the duct 70 thus define an annular air flow path which extends through the duct 70. The motor housing comprises a lower section 96 which supports the motor 92, and an upper section 98 connected to the lower section 96. The shaft 90 protrudes through an aperture formed in the lower section 96 of the motor housing to allow the impeller 80 to be connected to the shaft 90. The motor 92 is inserted into the lower section 96 of the motor housing before the upper section 98 is connected to the lower section 96.

The lower section 96 of the motor housing is generally frusto-conical in shape, and tapers inwardly in a direction extending towards the air inlet 72 of the duct 70. The hub 82 of the impeller 80 has a conical inner surface which has a similar shape to that of a contiguous part of the outer surface of the lower section 96 of the motor housing.

The upper section 98 of the motor housing is generally conical in shape, and tapers inwardly towards the air outlet 74 of the duct 70. The upper section 98 of the motor housing comprises an annular diffuser 100. The diffuser 100 comprises a plurality of blades 102 for guiding the air flow towards the air outlet 74 of the duct 70. The shape of the blades 102 is such that the air flow is also straightened as it passes through the diffuser 100. The diffuser 100 comprises 11 blades 102. One of the blades 102 defines a passageway through which a cable passes to the motor 92.

The outer wall 77 of the duct 70 comprises a diffuser housing 104 connected to the upper end of the impeller housing 78, and which extends about the diffuser 100. The diffuser housing 104 defines the air outlet 74 of the duct 70. The internal surface of the diffuser housing 104 is provided with grooves which receive the outer edges of the blades 102. The diffuser housing 104 and the upper section 98 of the motor housing define a diffuser section of the air flow path through the duct 70.

The upper section 98 of the motor housing is perforated. The inner surface of the upper section 98 of the motor housing is lined with noise absorbing material, preferably an acoustic foam material, to suppress broadband noise generated during operation of the fan 10. The noise absorbing material is not shown in the Figures so as to not obscure the perforations in the upper section 98 of the motor housing.

A retaining ring 124 is provided in an upper portion of the main body section 50 for preventing the motor housing from falling out of the main body section 50, for example during transit. The retaining ring 124 is provided with four angularly spaced recesses 126, the top side of which can be seen in FIG. 6. Located within each of the recesses 126 is a foam pad. The angularly spaced foam pads are arranged such that when the retaining ring 124 is secured to the main body section 50 the foam pads rest on corresponding angularly spaced members 128 which project outwardly from an outer surface of the diffuser housing 104. The foam pads reduce the transmission of vibrations from the motor housing 94 to the retaining ring 124.

The retaining ring 124 further comprises an annular sealing member 154. The annular sealing member 154 extends around the periphery of the retaining ring 124 and is trapped between the outer surface of the retaining ring 124 and the inner surface of the main body section 50. The sealing member 154 has a lip 156 which extends radially inwardly towards the longitudinal axis of the motor housing. The lip 156 is arranged such that when the nozzle 16 is located on the main body section 52 of the base 12 the lip 156 seals against an outer surface of the downwardly depending inner annular wall 150 defining the inner wall of the annular channel 134. This seal prevents the leakage of air as it passes from the air outlet 74 of main body section 50 and into the air inlet 42 of the nozzle 16. This ensures that the fan 10 can function even in the absence of the filter 14.

Referring to FIG. 7 band 8, the impeller housing 78 is mounted on an annular seat 106 located within the main body section 50 of the body 12. The seat 106 extends radially inwardly from the inner surface of the outer casing 24 so that an upper surface of the seat 106 is substantially orthogonal to the rotational axis Z of the impeller 80.

An annular seal 108 is located between the impeller housing 78 and the seat 106. The annular seal 108 is preferably a foam annular seal, and is preferably formed from a closed cell foam material. The outer diameter of the annular seal 108 is preferably smaller than the inner diameter of the outer casing 24 so that the annular seal 108 is spaced from the inner surface of the outer casing 24.

To operate the fan 10 the user presses button 20 of the user interface or a button on the remote control, in response to which the control circuit 62 activates the motor 92 to rotate the impeller 80. The rotation of the impeller 80 causes a primary air flow to be drawn through the air inlets 170 of the filter 14, through the two layers 162, 164 of filter media, and into the body 12 through the air inlet 22. Particles are thus removed from the air flow upstream from the air inlets 22 and do not enter the body 12. The user may control the speed of the motor 92, and therefore the rate at which air is drawn into the body 12, by pressing the appropriate buttons on the remote control.

The rotation of the impeller 80 by the motor 92 generates vibrations which are transferred through the motor housing and the impeller housing 78 towards the seat 106. The annular seal 108 located between the impeller housing 78 and the seat 106 is compressed under the weight of the duct 70, the impeller 80, the motor housing and the motor 92 so that it is in sealing engagement with the upper surface of the seat 106 and the impeller housing 78. The annular seal 108 thus not only prevents the primary air flow from returning to the air inlet 72 of the duct 70 along a path extending between the inner surface of the outer casing 24 of the main body section 50 and the outer wall 77 of the duct 70, but also reduces the transmission of these vibrations to the seat 106, and thus to the body 12 of the fan 10.

The air flow entering the body 12 through the air inlet 22 passes to the air inlet 72 of the duct 70. Within the duct 70, the primary air flow passes through the impeller housing 78 and the diffuser housing 104 to be emitted from the air outlet 74 of the duct 70 and into the air inlet 42 of the nozzle 16.

Within the interior passage 44 of the nozzle 16, the primary air flow is divided into two air streams which pass in opposite angular directions around the bore 19 of the nozzle 16. As the air streams pass through the interior passage 44, air is emitted through the air outlet 18. The emission of the primary air flow from the air outlet 18 causes a secondary air flow to be generated by the entrainment of air from the external environment, specifically from the region around the nozzle 16. This secondary air flow combines with the primary air flow to produce a combined, or total, air flow, or air current, projected forward from the nozzle 16.

Each of the air streams enters a respective one of the two vertically extending sections of the interior passage 44 of the nozzle 16, and is conveyed in a substantially vertical direction up through each of these sections of the interior passage 44. The set of guide vanes 120 located within each of these sections of the interior passage 44 directs the air stream towards the section of the mouth 18 located adjacent that vertically extending section of the interior passage 44. Each of the guide vanes 120 directs a respective portion of the air stream towards the section of the mouth 18 so that there is a substantially uniform distribution of the air stream along the length of the section of the mouth 18. The guide vanes 120 are shaped so that each portion of the air stream enters the mouth 18 in a substantially horizontal direction.

The primary air flow emitted from the mouth 18 is directed over the Coanda surface 34 of the nozzle 14, causing a secondary air flow to be generated by the entrainment of air from the external environment, specifically from the region around the mouth 18 and from around the rear of the nozzle 16. This secondary air flow passes predominantly through the central opening 19 of the nozzle 16, where it combines with the primary air flow to produce a total air flow, or air current, projected forward from the nozzle 16.

The even distribution of the primary air flow along the mouth 18 of the nozzle 16 ensures that the air flow passes evenly over the diffuser surface 34. The diffuser surface 34 causes the mean speed of the air flow to be reduced by moving the air flow through a region of controlled expansion. The relatively shallow angle of the diffuser surface 34 to the central axis X of the opening 19 allows the expansion of the air flow to occur gradually. A harsh or rapid divergence would otherwise cause the air flow to become disrupted, generating vortices in the expansion region. Such vortices can lead to an increase in turbulence and associated noise in the air flow, which can be undesirable, particularly in a domestic product such as a fan. In the absence of the guide vanes 120 most of the primary air flow would tend to leave the fan 10 through the upper part of the mouth 18, and to leave the mouth 18 upwardly at an acute angle to the central axis of the opening 19. As a result there would be an uneven distribution of air within the air current generated by the fan 10. Furthermore, most of the air flow from the fan 10 would not be properly diffused by the diffuser surface 34, leading to the generation of an air current with much greater turbulence.

The air flow projected forwards beyond the diffuser surface 34 can tend to continue to diverge. The presence of the guide surface 36 extending substantially parallel to the central axis X of the opening 19 tends to focus the air flow towards the user or into a room.

The invention is not limited to the detailed description given above. Variations will be apparent to the person skilled in the art.

For example, the base and the nozzle of the fan may be of a different shape and/or shape. The outlet of the mouth may be modified. For example, the outlet of the mouth may be widened or narrowed to a variety of spacings to maximise air flow. The air flow emitted from the mouth may pass over a surface, such as a Coanda surface, but alternatively the air flow may be emitted through the mouth and projected forward from the fan without passing over an adjacent surface. The Coanda effect may be effected over a number of different surfaces, or a number of internal or external designs may be used in combination to achieve the flow and entrainment required. The diffuser surface may be comprised of a variety of diffuser lengths and structures. The guide surface may be a variety of lengths, and may be arranged at a number of different positions and orientations as required for different fan requirements and different types of fan performance.

The invention claimed is:

1. A fan assembly comprising:

a body comprising an air inlet, an air outlet, and an air generator for generating an air flow through the body;

a nozzle for receiving the air flow from the air outlet of the body and for emitting the air flow;

a filter upstream from the air inlet and having an upstream surface and a downstream surface;

wherein the body comprises a seat having an upwardly facing surface for supporting the filter; and at least one sealing member for forming a seal between the filter and the body to define a flow path between the downstream surface of the filter and the air inlet;

wherein the at least one sealing member comprises a lower seal member provided adjacent the seat for forming a seal against a bottom surface of the filter and an upper seal member provided on the nozzle for forming a seal against an upper surface of the filter.

2. The fan assembly of claim 1, wherein the at least one sealing member is provided on the filter.

3. The fan assembly of claim 2, wherein the filter is provided with at least two sealing members.

4. The fan assembly of claim 1, wherein the filter is tubular and surrounds at least a portion of the body.

5. The fan assembly of claim 4, wherein the filter extends 360° around the body.

6. The fan assembly of claim 1, wherein the filter extends radially around at least a portion of the body.

7. The fan assembly of claim 1, wherein the seat is substantially orthogonal to a longitudinal axis of the body.

8. The fan assembly of claim 1, wherein the upwardly facing surface is inclined downwardly away from a longitudinal axis of the body.

9. The fan assembly of claim 1, wherein the upwardly facing surface of the seat comprises a first section which extends substantially perpendicular to a longitudinal axis of the body and a second section which is inclined downwardly relative to a longitudinal axis of the body.

10. The fan assembly of claim 1, wherein the filter comprises a plurality of wedge-shaped projections on a lower surface.

11. The fan assembly of claim 10, wherein the wedge-shaped projections taper upwardly and inwardly from an outer edge of the filter towards a longitudinal axis of the filter.

12. The fan assembly of claim 1, wherein the filter comprises a filter media comprising a HEPA filter.

13. The fan assembly of claim 1, wherein the filter comprises a filter media comprising an activated carbon cloth.

14. The fan assembly of claim 1, wherein the filter comprises a shroud surrounding a filter media of the filter.

15. The fan assembly of claim 1, wherein the at least one sealing member is annular.

16. The fan assembly of claim 1, wherein the nozzle defines an opening through which air from outside the fan assembly is drawn by the air emitted from the nozzle.

* * * * *